US010515615B2

(12) United States Patent
Elkins

(10) Patent No.: US 10,515,615 B2
(45) Date of Patent: Dec. 24, 2019

(54) SYSTEMS AND METHODS FOR VISUAL IMAGE AUDIO COMPOSITION BASED ON USER INPUT

(71) Applicant: Roy Elkins, Oregon, WI (US)

(72) Inventor: Roy Elkins, Oregon, WI (US)

( * ) Notice: Subject to any disclaimer, the term of this patent is extended or adjusted under 35 U.S.C. 154(b) by 0 days.

(21) Appl. No.: 15/753,393

(22) PCT Filed: Aug. 19, 2016

(86) PCT No.: PCT/US2016/047764
§ 371 (c)(1),
(2) Date: Feb. 19, 2018

(87) PCT Pub. No.: WO2017/031421
PCT Pub. Date: Feb. 23, 2017

(65) Prior Publication Data

US 2018/0247624 A1 Aug. 30, 2018

Related U.S. Application Data

(60) Provisional application No. 62/207,805, filed on Aug. 20, 2015.

(51) Int. Cl.
*G10H 1/00* (2006.01)
*G10H 1/18* (2006.01)

(52) U.S. Cl.
CPC ..... *G10H 1/0025* (2013.01); *G10H 1/18* (2013.01); *G10H 2210/105* (2013.01); *G10H 2210/125* (2013.01); *G10H 2220/091* (2013.01); *G10H 2220/355* (2013.01); *G10H 2220/441* (2013.01); *G10H 2240/145* (2013.01)

(58) Field of Classification Search
CPC .. G10H 1/0025; G10H 1/18; G10H 2210/105; G10H 2210/125; G10H 2220/091; G10H 2220/355; G10H 2220/441; G10H 2240/145
USPC ..... 84/615
See application file for complete search history.

(56) References Cited

U.S. PATENT DOCUMENTS 5,689,078 A * 11/1997 McClard ..... G10H 1/0008 84/464 R
6,529,584 B1 * 3/2003 Ravago ..... H04L 29/06027 379/101.01
7,723,603 B2 * 5/2010 Moffatt ..... G10H 1/0008 84/477 R
7,786,366 B2 * 8/2010 Moffatt ..... G10H 1/0083 84/600
8,058,544 B2 * 11/2011 Hoeberechts ..... G10H 1/0025 84/609
8,153,880 B2 * 4/2012 Sasaki ..... A63B 71/0686 84/612
8,242,344 B2 * 8/2012 Moffatt ..... G10H 1/0008 84/609
8,357,847 B2 * 1/2013 Huet ..... G10H 1/0025 84/609

(Continued)

*Primary Examiner* — David S Warren
*Assistant Examiner* — Christina M Schreiber
(74) *Attorney, Agent, or Firm* — Michael Best & Friedrich LLP

(57) ABSTRACT

The present invention relates to systems and methods for visual image audio composition. In particular, the present invention provides systems and methods for audio composition from a diversity of visual images and user determined sound database sources.

20 Claims, 18 Drawing Sheets

(56) References Cited

U.S. PATENT DOCUMENTS

| | | | | |
|---|---|---|---|---|
| 9,035,163 | B1 * | 5/2015 | Mohajer | G06Q 30/0277 84/615 |
| 9,336,760 | B2 * | 5/2016 | Singh | G10H 1/02 |
| 9,721,551 | B2 * | 8/2017 | Silverstein | G06N 7/005 |
| 10,056,062 | B2 * | 8/2018 | Reynolds | G09B 15/00 |
| 2003/0024375 | A1 * | 2/2003 | Sitrick | G09B 15/002 84/477 R |
| 2003/0037664 | A1 * | 2/2003 | Comair | G10H 1/0025 84/609 |
| 2004/0069121 | A1 * | 4/2004 | Georges | G10H 1/0025 84/609 |
| 2004/0074377 | A1 * | 4/2004 | Georges | G10H 1/0025 84/609 |
| 2005/0240396 | A1 * | 10/2005 | Childs | G10H 1/0025 704/207 |
| 2006/0122842 | A1 * | 6/2006 | Herberger | G10H 1/368 704/278 |
| 2007/0227337 | A1 * | 10/2007 | Yoshikawa | G10H 1/0025 84/602 |
| 2008/0298571 | A1 * | 12/2008 | Kurtz | H04N 7/142 379/156 |
| 2010/0180224 | A1 * | 7/2010 | Willard | G10H 1/0025 715/773 |
| 2013/0151556 | A1 * | 6/2013 | Watanabe | G10H 1/0025 707/769 |
| 2013/0322651 | A1 * | 12/2013 | Cheever | H03G 5/00 381/101 |
| 2015/0206540 | A1 * | 7/2015 | Green | G10L 19/00 704/207 |
| 2018/0247624 | A1 * | 8/2018 | Elkins | G10H 1/0025 |

* cited by examiner

| Primary | Type | A | B | C | D | E | F | G | H |
|---|---|---|---|---|---|---|---|---|---|
| Red | S1 | 234 | 120 | 104 | 32 | 90 | 157 | 57 | 239 |
| Green | S2 | 178 | 114 | 163 | 97 | 11 | 96 | 149 | 170 |
| Blue | S3 | 174 | 149 | 88 | 228 | 253 | 43 | 32 | 19 |
| R-G | D1 | 56 | 6 | -59 | -65 | 79 | 61 | -92 | 69 |
| R-B | D2 | 60 | -29 | 16 | -196 | -163 | 114 | 25 | 220 |
| G-R | D3 | 4 | -35 | 75 | -131 | -242 | 53 | 117 | 151 |
| G-B | D4 | 4 | -35 | 75 | -131 | -242 | 53 | 117 | 151 |
| B-R | D5 | -60 | 29 | -16 | 196 | 163 | -114 | -25 | -220 |
| B-G | D6 | -4 | 35 | -75 | 131 | 242 | -53 | -117 | -151 |
| R+G | D7 | 412 | 234 | 267 | 129 | 101 | 253 | 206 | 409 |
| R+B | D8 | 408 | 269 | 192 | 260 | 343 | 200 | 89 | 258 |
| G+B | D9 | 352 | 263 | 251 | 325 | 264 | 139 | 181 | 189 |
| R+G+B | D10 | 586 | 383 | 355 | 357 | 354 | 296 | 238 | 428 |
| R-(B+G) | D11 | -118 | -143 | -147 | -293 | -174 | 18 | -124 | 50 |
| G-(R+B) | D12 | -230 | -155 | -29 | -163 | -332 | -104 | 60 | -88 |
| B-(R+G) | D13 | -238 | -85 | -179 | 99 | 152 | -210 | -174 | -390 |

FIG. 2

| Variations | Type | A | B | C | D | E | F | G | H |
|---|---|---|---|---|---|---|---|---|---|
| B2-C2 | AD1 | | 114 | 16 | 72 | -58 | -67 | 100 | -182 |
| B3-C3 | AD2 | | 64 | -49 | 66 | 86 | -85 | -53 | -21 |
| B4-C4 | AD3 | | 25 | 61 | -140 | -25 | 210 | 11 | 13 |
| B5-C5 | AD4 | | 50 | 65 | 6 | -144 | 18 | 153 | -161 |
| B6-C6 | AD5 | | 89 | -45 | 212 | -33 | -277 | 89 | -195 |
| B7-C7 | AD6 | | 39 | -110 | 206 | 111 | -295 | -64 | -34 |
| B8-C8 | AD7 | | 39 | -110 | 206 | 111 | -295 | -64 | -34 |
| B9-C9 | AD8 | | -89 | 45 | -212 | 33 | 277 | -89 | 195 |
| B10-C10 | AD9 | | -39 | 110 | -206 | -111 | 295 | 64 | 34 |
| B11-C11 | AD10 | | 178 | -33 | 138 | 28 | -152 | 47 | -203 |
| B12-C12 | AD11 | | 139 | 77 | -68 | -83 | 143 | 111 | -169 |
| B13-C13 | AD12 | | 89 | 12 | -74 | 61 | 125 | -42 | -8 |
| B14-C14 | AD13 | | 203 | 28 | -2 | 3 | 58 | 58 | -190 |
| B15-C15 | AD14 | | 25 | 4 | 146 | -119 | -192 | 142 | -174 |
| B16-C16 | AD15 | | -75 | -126 | 134 | 169 | -228 | -164 | 148 |
| B17-C17 | AD16 | | -153 | 94 | -278 | -53 | 362 | -36 | 216 |

FIG. 3

SYSTEMS AND METHODS FOR VISUAL IMAGE AUDIO COMPOSITION BASED ON USER INPUT

This application is a national phase application under 35 U.S.C. § 371 of PCT International Application No. PCT/US2016/047764, filed on Aug. 19, 2016, which claims priority to U.S. Patent Application Ser. No. 62/207,805, filed on Aug. 20, 2015, each of which is incorporated herein by reference in its entirety for all purposes.

FIELD OF THE INVENTION

The present invention relates to systems and methods for visual image audio composition. In particular, the present invention provides systems and methods for audio composition from a diversity of visual images and user determined sound database sources.

BACKGROUND OF THE INVENTION

Listeners and viewers may associate a visual experience with an audio experience, or an audio experience with a visual experience. In certain settings the association of a visual experience with an audio experience may have particular value in, for example, personal entertainment, the entertainment industry, advertising, sports, game playing, inter-personal and inter-institutional communication and the like. At present, however, it is not possible for a user to acquire a preferred visual image, text and/or global positioning system (GPS) data and convert it to a preferred audio composition in real time wherein the user's preferences guide a computer system to generate an audio composition that comprises, for example, the user's input relating to one or more visual image regions, the user's input relating to one or more audio parameters, the user's input relating to methods of generating the audio output, the user's input relating to compatibility of one or more audio outputs, and/or the user's input relating methods of audio storage, reproduction and distribution. Accordingly, the present invention provides methods, systems, devices and kits for conversion of a preferred visual image to a preferred audio composition in, for example, real time and/or off-line.

DESCRIPTION OF THE DRAWINGS

FIG. 2 shows a subset of pixel values and pixel differentials used when a visual image is captured and converted to an audio output.

FIG. 3 shows a subset of further pixel differentials used when a visual image is captured and converted to an audio output.

SUMMARY OF THE INVENTION

Figure 1:
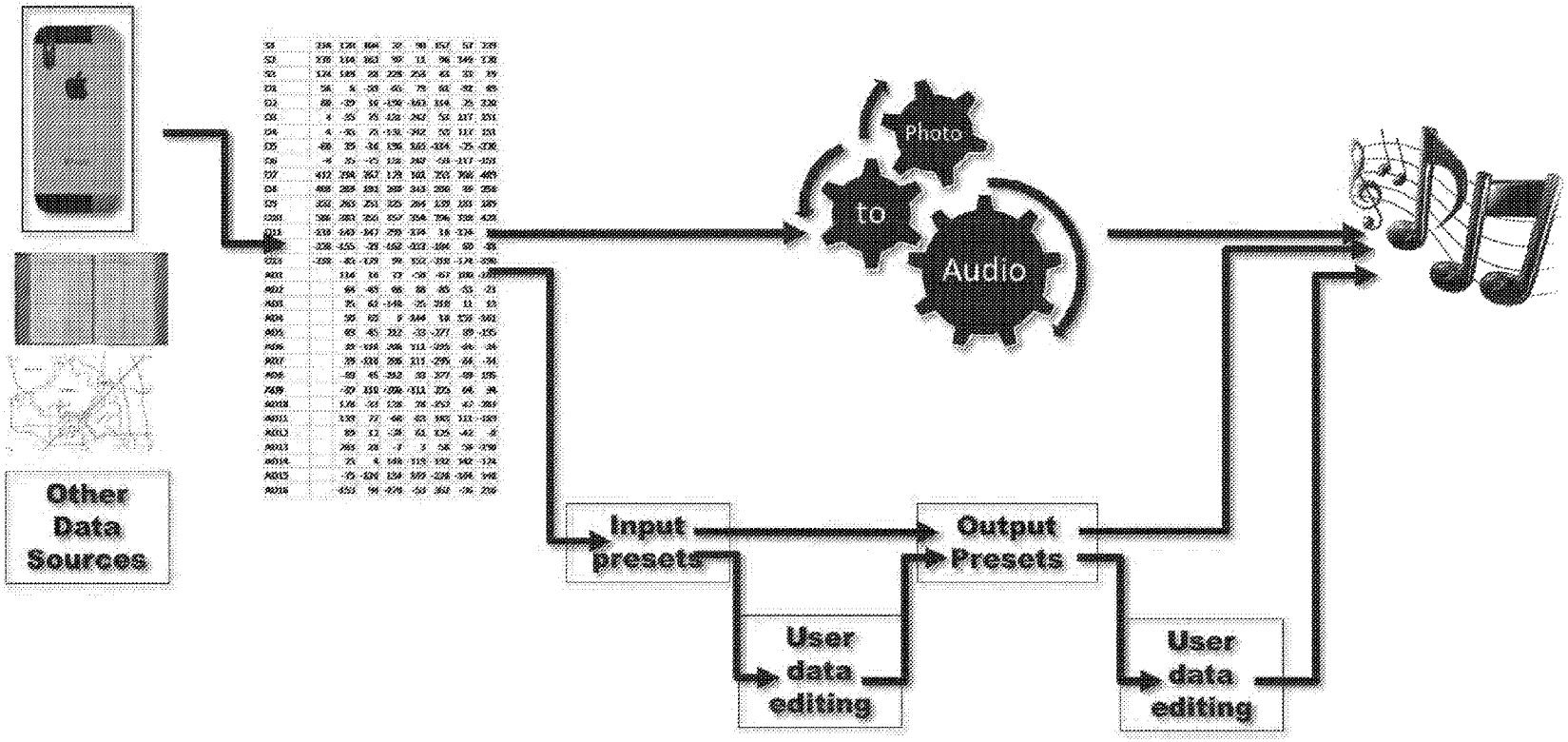
FIG. 1 shows an overview of an embodiment of the present invention wherein data from an image on a cell phone is converted to an audio output.

In some embodiments, the present invention provides a method for audio composition generation using at least one computer system comprising a processor, a user interface, a visual image display screen, a sound database, an audio composition computer program on a computer readable medium configured to receive input from the visual image display screen and from the sound database to generate an audio composition, and an audio system, comprising displaying a visual image on the visual image display screen, receiving a user's input relating to one or more audio parameters, scanning the visual image to identify a plurality of visual image regions, selecting and assembling a plurality of blocks in the sound database based on the visual image regions and the user's input of the one or more audio parameters, and generating an audio composition based on selecting and assembling the plurality of blocks in the sound database using the audio system.

In some embodiments, generating an audio composition based on selecting and assembling a plurality of blocks in the sound database using said audio system is performed in real time. In particular embodiments, a visual image on a visual image display screen comprises a digital photograph, a digital photograph selected from a digital photograph database, a digital photograph selected from a web-based database, a captured digital image, a digital video image, a film image, a visual hologram, a user-edited visual image or other visual image.

In certain embodiments, a plurality of blocks in a sound database comprise a note comprising a duration, pitch, volume or tonal content, or a plurality of notes comprising melody, harmony, rhythm, tempo, voice, key signature, key change, intonation, temper, repetition, tracks, samples, loops, riffs, counterpoint, dissonance, sound effects, reverberation, delay, chorus, flange, dynamics, instrumentation, artist or artists' sources, musical genre or style, monophonic and stereophonic reproduction, equalization, compression and mute/unmute blocks. In further embodiments, the plurality of blocks in the sound database comprise a recorded analog or digital sound, an analog or digital sound selected from a recording database, a digital sound selected from a web-based database, a user-recorded or a user-generated sound, a user-edited analog or digital sound, or other sound. In further embodiments, one or more blocks in a sound database are assigned a tag. In still further embodiments, the selecting and assembling a one or more blocks from the sound database based on visual image regions and a user's input of the one or more audio parameter preferences comprises at least one user-determined filter to pass or to not pass one or more tags of one or more blocks to the auditory composition. In preferred embodiments, methods and systems of the present invention comprise receiving a user's input relating to the compatibility, alignment and transposition of a plurality of passed blocks from a sound database to the audio composition.

In some embodiments, the present invention comprises a touchscreen interface, a keyboard interface, a tactile interface, a motion interface, a voice recognition interface, or other interface. In other embodiments, a visual image display screen comprises at least one cursor configured to scan a static, or dynamic moving, visual image for input relating to at least one visual image region of a displayed visual image. In particular embodiments, the methods further comprise receiving a user's input relating to the plurality of said visual image regions. In further embodiments, receiving a user's input relating to one or more visual image regions of a displayed visual image comprises a user's input relating to the number, orientation, dimensions, rate of travel, direction of travel, steerability and image resolution of at least one cursor. In still further embodiments, a user's input relating to at least one visual image region of a displayed visual image comprises input relating to one or more pixel dimensions, coordinates, brightness, grey scale, Red-Green-Blue (RGB) scale, visual image regions comprising a plurality of pixels with user input relating to dimensions, color, tone, composition, content, feature resolution, a combination thereof, or a user-edited visual image region.

In some embodiments, methods of the invention further comprise receiving a user's input relating to an audio composition computer program on a computer readable medium. In other embodiments, the invention further comprises receiving a user's input relating to generating an audio composition using an audio system.

In some embodiments, an audio composition is stored on a computer readable medium, stored in a sound database, stored on a web-based medium, edited, privately shared, publicly shared, available for sale, licensed, or back-converted to a visual image.

In some embodiments, an audio composition computer program on a computer readable medium configured to receive input from a visual image display screen and from a sound database to generate an audio composition is downloadable to a mobile device, a phone, a tablet, a computer, a device configured to receive Mp3 files, or other digital source.

In some embodiments, methods of the invention further comprise receiving auditory input in real time. In other embodiments, methods further comprise receiving GPS coordinates to filter one or more blocks of a sound database specific to a location, or to the distance, rate and direction of travel, latitude, longitude, street names, locations, topography, population, between a plurality of locations. In other embodiments, the invention provides methods wherein analysis wherein a visual image on a visual image display screen is a visual image of a text, for example, of American Standard Code for Information Interchange (ASCII) text, or any other standard texts and formats.

In some embodiments, the invention provides systems for musical composition, comprising a processor, a user interface, a visual image display screen, a sound database, a computer program on a computer readable medium configured to receive input from a visual image display screen and from a sound database to generate an auditory presentation comprising an audio composition, and an audio system. In certain embodiments, the system further comprises one or more hardware modulators and/or at least one wireless connection, and/or cable by wire connection. In other embodiments, the system further comprises a video game as a visual image source for generation of one or more audio compositions.

Definitions

To facilitate an understanding of the present invention, a number of terms and phrases are defined below:

As used herein, "audio display" or "audio presentation" refers to audio sounds presented to and perceptible by the user and/or other listeners. Audio display may be directly correlated to a note element or elements. An "audio display unit" is a device capable of presenting an audio display to the user (e.g., a sound system or an audio system).

As used herein, the term "codec" refers to a device, either software or hardware, that translates video or audio between its uncompressed form and the compressed form (e.g., MPEG-2) in which it is stored. Examples of codecs include, but are not limited to, CINEPAK, SORENSON VIDEO, INDEO, and HEURIS codecs. "Symetric codecs" encodes and decodes video in approximately the same amount of time. Live broadcast and teleconferencing systems generally use symetric codecs in order to encode video in real time as it is captured.

As used herein, the term "compression format" refers to the format in which a video or audio file is compressed. Examples of compression formats include, but are not limited to, MPEG-1, MPEG-2, MPEG-4, M-JPEG, DV, and MOV.

As used herein, the terms "computer memory" and "computer memory device" refer to any storage media readable by a computer processor. Examples of computer memory include, but are not limited to, RAM, ROM, computer chips, digital video discs (DVD), compact discs (CDs), hard disk drives (HDD), and magnetic tape.

As used herein, the term "computer readable medium" refers to any device or system for storing and providing information (e.g., data and instructions) to a computer processor. Examples of computer readable media include, but are not limited to, DVDs, CDs, hard disk drives, magnetic tape, cloud storage, and servers for streaming media over networks.

As used herein, the term "computing unit" means any system that includes a processor and memory. In some embodiments, a computing unit may also contain a video display. In some embodiments, a computing unit is a self-contained system. In some embodiments, a computing unit is not self-contained.

As used herein the term "conference bridge" refers to a system for receiving and relaying multimedia information to and from a plurality of locations. For example, a conference bridge can receive signals from one or more live events (e.g., in the form of audio, video, multimedia, or text information), transfer information to a processor or a speech-to-text conversion system, and send processed and/or unprocessed information to one or more viewers connected to the conference bridge. The conference bridge can also, as desired, be accessed by system administrators or any other desired parties.

As used herein, the terms "central processing unit" ("CPU") and "processor" are used interchangeably and refer to a device that is able to read a program from a computer memory (e.g., ROM or other computer memory and perform a set of steps according to the program).

The term "database" is used to refer to a data structure for storing information for use by a system, and an example of such a data structure in described in the present specification.

As used herein, the term "digitized video" refers to video that is either converted to digital format from analog format or recorded in digital format. Digitized video can be uncompressed or compressed into any suitable format including, but not limited to, MPEG-1, MPEG-2, DV, M-JPEG or MOV. Furthermore, digitized video can be delivered by a variety of methods, including playback from DVD, broadcast digital TV, and streaming over the Internet.

As used herein, the term "encode" refers to the process of converting one type of information or signal into a different type of information or signal to, for example, facilitate the transmission and/or interpretability of the information or signal. For example, image files can be converted into (i.e., encoded into) electrical or digital information, and or audio files. Likewise, light patterns can be converted into electrical or digital information that provides an encoded video capture of the light patterns. As used herein, the term "separately encode" refers to two distinct encoded signals, whereby a first encoded set of information contains a different type of content than a second encoded set of information. For example, multimedia information containing audio and video information is separately encoded wherein video information is encoded into one set of information while the audio information is encoded into a second set of information. Likewise, multimedia information is separately encoded wherein audio information is encoded and processed in a first set of information and text corresponding to the audio information is encoded and/or processed in a second set of information.

As used herein, the term "hash" refers to a map of large data sets to smaller data sets performed by a hash function. For example, a single hash can serve as an index to an array of "match sources". The values returned by a hash function are called hash values, hash codes, hash sums, checksums or simply hashes.

As used herein, the term "hyperlink" refers to a navigational link from one document to another, or from one portion (or component) of a document to another. Typically, a hyperlink is displayed as a highlighted word or phrase that can be selected by clicking on it using a mouse to jump to the associated document or documented portion.

As used herein the term "information stream" refers to a linearized representation of multimedia information (e.g., audio information, video information, text information). Such information can be transmitted in portions over time (e.g., file processing that does not require moving the entire file at once, but processing the file during transmission (the stream)). For example, streaming audio or video information utilizes an information stream. As used herein, the term "streaming" refers to the network delivery of media. "True streaming" matches the bandwidth of the media signal to the viewer's connection, so that the media is seen in real time. As is known in the art, specialized media servers and streaming protocols are used for true streaming. For example, RealTime Streaming Protocol (RTSP, REALNETWORKS) is a standard used to transmit true streaming media to one or more viewers simultaneously. RTSP provides for viewers randomly accessing the stream, and uses RealTime Transfer Protocol (RTP, REALNETWORKS) as the transfer protocol. RTP can be used to deliver live media to one or more viewers simultaneously. "HTTP streaming" or "progressive download" refers to media that may be viewed over a network prior to being fully downloaded.

Examples of software for "streaming" media include, but are not limited to, QUICKTIME, NETSHOW, WINDOWS MEDIA, REALVIDEO, REALSYSTEM G2, and REALSYSTEM 8. A system for processing, receiving, and sending streaming information may be referred to as a "stream encoder" and/or an "information streamer."

As used herein, the term "Internet" refers to any collection of networks using standard protocols. For example, the term includes a collection of interconnected (public and/or private) networks that are linked together by a set of standard protocols (such as TCP/IP, HTTP, and FTP) to form a global, distributed network. While this term is intended to refer to what is now commonly known as the Internet, it is also intended to encompass variations that may be made in the future, including changes and additions to existing standard protocols or integration with other media (e.g., television, radio, etc.). The term is also intended to encompass non-public networks such as private (e.g., corporate) Intranets.

As used herein, the terms "World Wide Web" or "web" refer generally to both (i) a distributed collection of interlinked, user-viewable hypertext documents (commonly referred to as Web documents or Web pages) that are accessible via the Internet, and (ii) the client and server software components which provide user access to such documents using standardized Internet protocols. Currently, the primary standard protocol for allowing applications to locate and acquire Web documents is HTTP, and the Web pages are encoded using HTML. However, the terms "Web" and "World Wide Web" are intended to encompass future markup languages and transport protocols that may be used in place of (or in addition to) HTML and HTTP.

As used herein, the term "web site" refers to a computer system that serves informational content over a network using the standard protocols of the World Wide Web. Typically, a Web site corresponds to a particular Internet domain name and includes the content associated with a particular organization. As used herein, the term is generally intended to encompass both (i) the hardware/software server components that serve the informational content over the network, and (ii) the "back end" hardware/software components, including any non-standard or specialized components, that interact with the server components to perform services for Web site users.

As used herein, the term "HTML" refers to HyperText Markup Language that is a standard coding convention and set of codes for attaching presentation and linking attributes to informational content within documents. During a document authoring stage, the HTML codes (referred to as "tags") are embedded within the informational content of the document. When the Web document (or HTML document) is subsequently transferred from a Web server to a browser, the codes are interpreted by the browser and used to parse and display the document. Additionally, in specifying how the Web browser is to display the document, HTML tags can be used to create links to other Web documents (commonly referred to as "hyperlinks").

As used herein, the term "HTTP" refers to HyperText Transport Protocol that is the standard World Wide Web client-server protocol used for the exchange of information (such as HTML documents, and client requests for such documents) between a browser and a Web server. HTTP includes a number of different types of messages that can be sent from the client to the server to request different types of server actions. For example, a "GET" message, which has the format GET, causes the server to return the document or file located at the specified URL.

As used herein, the term "URL" refers to Uniform Resource Locator that is a unique address that fully specifies the location of a file or other resource on the Internet. The general format of a URL is protocol://machine address:port/path/filename. The port specification is optional, and if none is entered by the user, the browser defaults to the standard port for whatever service is specified as the protocol. For example, if HTTP is specified as the protocol, the browser will use the HTTP default port of 80.

As used herein, the term "PUSH technology" refers to an information dissemination technology used to send data to users over a network. In contrast to the World Wide Web (a "pull" technology), in which the client browser must request a Web page before it is sent, PUSH protocols send the informational content to the user computer automatically, typically based on information pre-specified by the user.

As used herein the term "security protocol" refers to an electronic security system (e.g., hardware and/or software) to limit access to processor to specific users authorized to access the processor. For example, a security protocol may comprise a software program that locks out one or more functions of a processor until an appropriate password is entered.

As used herein the term "viewer" or "listener" refers to a person who views text, audio, images, video, or multimedia content. Such content includes processed content such as information that has been processed and/or translated using the systems and methods of the present invention. As used herein, the phrase "view multimedia information" refers to the viewing of multimedia information by a viewer. "Feedback information from a viewer" refers to any information sent from a viewer to the systems of the present invention in response to text, audio, video, or multimedia content.

As used herein the term "visual image region" refers to a viewer display comprising two or more display fields, such that each display field can contain different content from one another. For example, a display with a first region displaying a first video or image and a second region displaying a second video or image field comprises distinct viewing fields. The distinct viewing fields need not be viewable at the same time. For example, viewing fields may be layered such that only one or a subset of the viewing fields is displayed. The un-displayed viewing fields can be switched to displayed viewing fields by the direction of the viewer. In some embodiments, a "visual image region" is a visually detected element that is correlated to at least one audio element. A "visual image region" element may, for example, be correlated to one or more aspects of an audio element, including but not limited to, for example, pitch and duration. In preferred embodiments, a "visual image region" element correlates to both pitch and duration of a note element. A "visual image region" element may, in some embodiments, include correlation to a volume of an audio element. A pattern or frequency of a plurality of "visual image region" elements may correlate to a rhythm of a plurality of audio elements. A "visual image region" may be presented simultaneously or sequentially. A "visual image region" element may be presented prior to, simultaneously with, or after an audio presentation of a corresponding note, and may comprise one or more "visual image sub-regions". In other embodiments, a "visual image region" is the dimensioned physical width that a visual element may occupy on a graphical display.

As used herein the term "viewer output signal" refers to a signal that contains multimedia information, audio information, video information, and/or text information that is delivered to a viewer for viewing the corresponding multimedia, audio, video, and/or text content. For example, viewer output signal may comprise a signal that is receivable by a video monitor, such that the signal is presented to a viewer as text, audio, and/or video content.

As used herein, the term "compatible with a software application" refers to signals or information configured in a manner that is readable by a software application, such that the software application can convert the signal or information into displayable multimedia content to a viewer.

As used herein, the term "in electronic communication" refers to electrical devices (e.g., computers, processors, etc.) that are configured to communicate with one another through direct or indirect signaling. For example, a conference bridge that is connected to a processor through a cable or wire, such that information can pass between the conference bridge and the processor, are in electronic communication with one another. Likewise, a computer configured to transmit (e.g., through cables, wires, infrared signals, telephone lines, etc.) information to another computer or device, is in electronic communication with the other computer or device.

As used herein, the term "transmitting" refers to the movement of information (e.g., data) from one location to another (e.g., from one device to another) using any suitable means.

As used herein, the term "XML" refers to Extensible Markup Language, an application profile that, like HTML, is based on SGML. XML differs from HTML in that: information providers can define new tag and attribute names at will; document structures can be nested to any level of complexity; any XML document can contain an optional description of its grammar for use by applications that need to perform structural validation. XML documents are made up of storage units called entities, which contain either parsed or unparsed data. Parsed data is made up of characters, some of which form character data, and some of which form markup. Markup encodes a description of the document's storage layout and logical structure. XML provides a mechanism to impose constraints on the storage layout and logical structure, to define constraints on the logical structure and to support the use of predefined storage units. A software module called an XML processor is used to read XML documents and provide access to their content and structure.

As used herein, the term "intermediary service provider" refers to an agent providing a forum for users to interact with each other (e.g., identify each other, make and receive visual images, etc.). In some embodiments, the intermediary service provider is a hosted electronic environment located on the Internet or World Wide Web.

As used herein, the term "client-server" refers to a model of interaction in a distributed system in which a program at one site sends a request to a program at another site and waits for a response. The requesting program is called the "client," and the program which responds to the request is called the "server." In the context of the World Wide Web, the client is a "Web browser" (or simply "browser") that runs on a computer of a user; the program which responds to browser requests by serving Web pages is commonly referred to as a "Web server."

As used herein, the term "hosted electronic environment" refers to an electronic communication network accessible by computer for transferring information. One example includes, but is not limited to, a web site located on the world wide web.

As used herein the terms "multimedia information" and "media information" are used interchangeably to refer to information (e.g., digitized and analog information) encoding or representing audio, video, and/or text. Multimedia information may further carry information not corresponding to audio or video. Multimedia information may be transmitted from one location or device to a second location or device by methods including, but not limited to, electrical, optical, and satellite transmission, and the like.

As used herein the term "audio information" refers to information (e.g., digitized and analog information) encoding or representing audio. For example, audio information may comprise encoded spoken language with or without additional audio. Audio information includes, but is not limited to, audio captured by a microphone and synthesized audio (e.g., computer generated digital audio).

As used herein the term "video information" refers to information (e.g., digitized and analog information) encoding or representing video. Video information includes, but is not limited to video captured by a video camera, images captured by a camera, and synthetic video (e.g., computer generated digital video).

As used herein the term "text information" refers to information (e.g., analog or digital information) encoding or representing written language or other material capable of being represented in text format (e.g., corresponding to spoken audio). For example, computer code (e.g., in .doc, .ppt, or any other suitable format) encoding a textual transcript of a spoken audio performance comprises text information. In addition to written language, text information may also encode graphical information (e.g., figures, graphs, diagrams, shapes) related to, or representing, spoken audio. "Text information corresponding to audio information" comprises text information (e.g., a text transcript) substantially representative of a spoken audio performance. For example, a text transcript containing all or most of the words of a speech comprises "text information corresponding to audio information."

As used herein the term "configured to receive multimedia information" refers to a device that is capable of receiving multimedia information. Such devices contain one or more components configured to receive at least one signal carrying multimedia information. In preferred embodiments, the receiving component is configured to transmit the multimedia information to a processor.

As used herein, the term "customer" refers to a user (e.g., a viewer or listener) of the systems of the present invention that can view events or listen to content and request services for events and content and/or pay for such services.

As used herein, the term "player" (e.g., multimedia player) refers to a device or software capable of transforming information (e.g., multimedia, audio, video, and text information) into displayable content to a viewer (e.g., audible, visible, and readable content).

As used herein, "note element" is a unit of sound whose pitch, and/or duration is directed by an audio file such as a MIDI file. In some embodiments, a note element is generated by a user in response to a music-making cue. In some embodiments, a note element is generated by a computing unit.

The term "user" refers to a person using the systems or methods of the present invention. In some embodiments, the subject is a human.

As used herein, "visual image region window" refers to an adjustable unit of presentation time relating to a "visual image region" element.

As used herein, the term "incoming visual image region" refers to a "visual image region" element that has appeared on the graphical display/user interface and that is moving toward the point or position on the display that signals the first audio presentation of the corresponding sound.

As used herein, the term "video display" refers to a video that is actively running, streaming, or playing back on a display device.

As used herein, the term "MIDI" stands for musical instrument digital interface. "MIDI file" refers to any file that contains at least one audio track that conforms to a MIDI format. The term MIDI is known in the art as an industry-standard protocol defined in 1982 that enables electronic musical instruments such as keyboard controllers, computers, and other electronic equipment to communicate, control, and synchronize with each other. MIDI allows computers, synthesizers, MIDI controllers, sound cards, samplers and drum machines to control one another, and to exchange system data (acting as a raw data encapsulation method for sysex commands). MIDI does not transmit an audio signal or media—it transmits "event messages" such as the pitch, velocity and intensity of musical notes to play, control signals for parameters such as volume, vibrato and panning, cues, and clock signals to set the tempo. As an electronic protocol, it is notable for its widespread adoption throughout the industry. Versions of MIDI include but are not limited to MIDI 1.0, General MIDI (GM), General MIDI level 2 (GM2), GS, XG, and Scalable Polyphony MIDI (SP-MIDI). MIDI file formats include but are not limited to SMF format, .KAR format, XMF file formats, RIFF-RMID file format, extended RMID file format, and .XMI file format.

As used herein, the term "pitch" refers, for example, to any playable instrument sound that can be mapped to a MIDI instrument key or program number. For some instruments, e.g., piano, standard MIDI assignments describe a range of ascending musical pitches associated with the fundamental frequencies of the sounds. For other sounds such as amelodic instruments, e.g., drums, or sound effects (e.g., gunshot, bird tweet), pitch refers to the particular selected sound associated with the MIDI assignment. In some embodiments, pitch is a property of a note element. In some embodiments, pitch is a property of an audio presentation. In some embodiments, pitch may be specified by a game element.

As used herein, the term "rhythm" means the temporal property of a sound. One skilled in the art will appreciate that the duration for which a sound is sustained, and the timing of the sound with respect to other sound events, are inherent properties of rhythm. In some embodiments, rhythm is a property of a note element. In some embodiments, rhythm is a property of an audio composition. In some embodiments, rhythm may be specified by a "visual image region". In other embodiments, rhythm is a property of one or more visual elements on a display surface.

As used herein, the term "calibration step" means a process by which the dimension of at least one "visual image region" element is adjusted to substantially correspond with the dimension of at least one audio source. In some embodiments, the dimension that is adjusted during the calibration step is width or length.

As used herein, the term "alignment" or "substantially aligned" means a correspondence between at least one dimension of at least one graphical element with at least one audio block. In some embodiments, the descriptors of at least one "visual image region" graphical element are aligned with at least one audio block.

As used herein, the term "audio-making cues" means a presentation of a user-predetermined visual image region and a user pre-determined audio block information to a processor with the goal of prompting the processor correlate the user-predetermined visual image region and a user pre-determined audio block information to produce an audio composition.

As used herein, the term "timing" refers to the moment of initiation and/or cessation of a note element.

As used herein, the term "duration" means the length of time that a note element is sustained.

As used herein, the term "sequence" means the order in which note elements are presented, played, occur, or are generated. Sequence may also refer to the order in which music making cues signal that note elements are to be presented played, occur, or are generated.

As used herein, "music file" means any computer file encoding musical information.

The processing unit of a system for visual image audio composition of the present invention may be any sort of computer, for example, ready-built or custom-built, running an operating system. In preferred embodiments, manual data is input to the processing unit through voice recognition, touch screen, keyboard, buttons, knobs, mouse, pointer, joystick, motion detectors, vibration detectors, location detectors or analog or digital devices. In some embodiments, devices are viewed commercially as cellular telephones with computing capability, or as hand-held computers with cellular capability, or any small, portable computing device which can be programmed to receive the necessary data inputs and correlate the audio composition information described herein, regardless of whether, for example, such devices are viewed commercially as cellular telephones with computing capability, or as hand-held computers with cellular capability.

DETAILED DESCRIPTION OF THE INVENTION

In some embodiments, the present invention provides methods and systems for visual image audio composition wherein a user selects one or more visual images and, based on the content of the visual image and a user-selected rule set and audio database, generates an audio composition (for example, music or a song audio composition). (FIG. 1.) By applying the rules and database to the user selected visual image, different images may generate different audio compositions, for example, different music or songs. In certain embodiments, different regions of a visual image generate different parts of components of an audio composition.

The present invention relates to systems and methods for visual image audio composition. In particular, the present invention provides methods and systems for audio composition from a diversity of visual images and user determined sound database sources. In certain embodiments, the methods and systems of the present invention to transform images into sounds comprise, for example, devices such as phones, tablets, computers and other software based technologies. In some embodiments, the methods and systems employ an operating system such as, for example, IOS, Android, MAC and PCR operating systems. In other embodiments, methods and systems of the present invention employ downloadable mobile applications configured for a diversity of platforms including, for example, MS and Android platforms.

The systems and methods of the present invention may be applied using any type of computer system, including traditional desktop computers, as well as other computing devices (e.g., calculators, phones, watches, personal digital assistants, etc.). In some embodiments, the computer system comprises computer memory or a computer memory device and a computer processor. In some embodiments, the computer memory (or computer memory device) and computer processor are part of the same computer. In other embodiments, the computer memory device or computer memory is located on one computer and the computer processor is located on a different computer. In some embodiments, the computer memory is connected to the computer processor through the Internet or World Wide Web. In some embodiments, the computer memory is on a computer readable medium (e.g., floppy disk, hard disk, compact disk, memory stick clou server, DVD, etc.). In other embodiments, the computer memory (or computer memory device) and computer processor are connected via a local network or intranet.

In some embodiments, "a processor" may comprise multiple processors in communication with each other for carrying out the various processing tasks required to reach the desired end result. For example, the computer of an intermediary service provider may perform some processing or information storage and the computer of a customer linked to the intermediary service provider may perform other processing or information storage.

For use in such applications, the present invention provides a system comprising a processor, said processor configured to receive multimedia information and a plurality of user inputs and encode information streams comprising a separately encoded first visual image stream and a separately encoded second auditory stream from the auditory library/database information, said first information stream comprising visual image information and said second information stream comprising auditory information. The present invention is not limited by the nature of the visual image or auditory information.

In some embodiments, the system further comprises a visual image to audio converter, wherein the visual image to audio converter is configured to produce an audio composition from a visual image and sound database. In some embodiments, the processor further comprises a security protocol. In some preferred embodiments, the security protocol is configured to restrict participants and viewers from controlling the processor (e.g., a password protected processor). In other embodiments, the system further comprises a resource manager (e.g., configured to monitor and maintain efficiency of the system). In some embodiments, the system further comprises a conference bridge configured to receive the visual image and auditory information, wherein the conference bridge is configured to provide the multimedia information to the processor. In some embodiments, the conference bridge is configured to receive multimedia information from a plurality of sources (e.g., sources located in different geographical regions). In other embodiments, the conference bridge is further configured to allow the multimedia information to be viewed or heard (e.g., is configured to allow one or more viewers to have access to the systems of the present invention).

In some embodiments, the system further comprises a text to speech converter configured to convert at least a portion of the text information to audio.

In some embodiments, the system further comprises a software application configured to display a first and/or the second information streams (e.g., allowing a viewer to listen to audio, and view video). In some preferred embodiments, the software application is configured to display the text information in a distinct viewing field.

The present invention further provides a system for interactive electronic communications comprising a processor, wherein the processor is configured to receive multimedia information, encode an information stream comprising text information, send the information stream to a viewer, wherein the text information is synchronized with an audio or video file, and receive feedback information from the viewer.

I. Visual Image and Other Sources

In some embodiments of the present invention, one or more preferred visual images are displayed on a visual image display screen. In particular embodiments the visual image comprises a digital photograph, a digital photograph selected from a digital photograph database, a digital photograph selected from a web-based database, a captured digital image, a digital video image, a film image, a visual hologram or a user-edited visual image. In further embodiments, the user's input relating to a plurality of said visual image regions of a displayed visual image comprises input relating to one or more pixel dimensions, coordinates, brightness, grey scale, or RGB scale, visual image regions comprising a plurality of pixels with user input relating to dimensions, color, tone, composition, content, feature resolution, a combination thereof, or a user-edited visual image region. For example, the Red, Green & Blue pixel values may be provided on a scale of 0-255. Based on the combination of the 3 values, a final color is determined and selected to direct audio downloads based on user preferences for audio content.

In some embodiments, the methods and systems of the present invention provide Red, Green and Blue pixel values measured on a scale of 0-255, with 0 being the darkest and 255 being the lightest. Therefore, each pixel in a digital image comprise three attributed values. The value of the Red pixel, the Blue pixel and the Green pixel may be used to select which note is played, or to trigger sounds for audio output. A first option is to analyze and determine audio output from these values based on their value in a scale. The user may also use the relationships between the pixels to govern the oscillators, amplifiers, filters, modulators and other effects. For example, if the Red pixel has a value of 234, and the Green pixel has value of 178, other values may be determined from the two values. Subtracting the Green value from the Red value generates a value of 56. Subtracting the Red value from the Green value generates a value of −56. Adding the values r generates a value of 412. (FIG. 2.) Pixel values may be added, subtracted, multiplied, divided, squared, etc. to create additional values to generate audio output. (FIG. 2 and FIG. 3.)

Any photo, visual image or other media source may be converted into an audio composition using methods and systems of the present invention. In some embodiments, the methods and systems of the present invention comprise a digital image or photograph, an analog photograph or image converted to a digital photograph or image, a video image or screen shot, a running video image, film, a 3-D hologram, a dynamic 3-D hologram and the like. In some embodiments, the analog to digital conversion is performed on pixel spatial resolution, pixel filters, pixel grey scale and pixel color scale. In other embodiments, the visual image comprises one or more visual illusions, ambiguous images, and/or just noticeable visual image differences. In certain embodiments, the user selects a preferred visual or video image from a visual or video library. In further embodiments, a user acquires a photograph with an integrated device, and the image is converted into music based on assigned pixel values in real time. In some embodiments, pixel values are provided by default. In other embodiments, pixel values are selected from a database of pixel values, In further embodiments, pixel values are programmable and may be altered to generate a diversity of audio loops, samples, tones, effects, volumes, pitches and the like. In still further embodiments, a user selects pre-programmed loops, and loops that are stretched and compressed without changing pitch. In other embodiments, visual images are acquired in real time, for example, an analog or digital visual image, by one or more cameras comprising content of particular value to a user, and an audio composition is created in real time as the displayed visual image changes in real time.

In some embodiments, the displayed visual image comprises text. In certain embodiments, the user may select digital translation of text in a first language into text of a second language before generation of an audio composition. In further embodiments, the user may select conversion of text into a one or more displayed non-textual visual images. In still further embodiments, text may be provided from social media, scanned using methods and systems of the present invention comprising user inputs to generate an audio composition corresponding to, for example, a FaceBook, LinkedIn or Twitter message.

Figure 4:
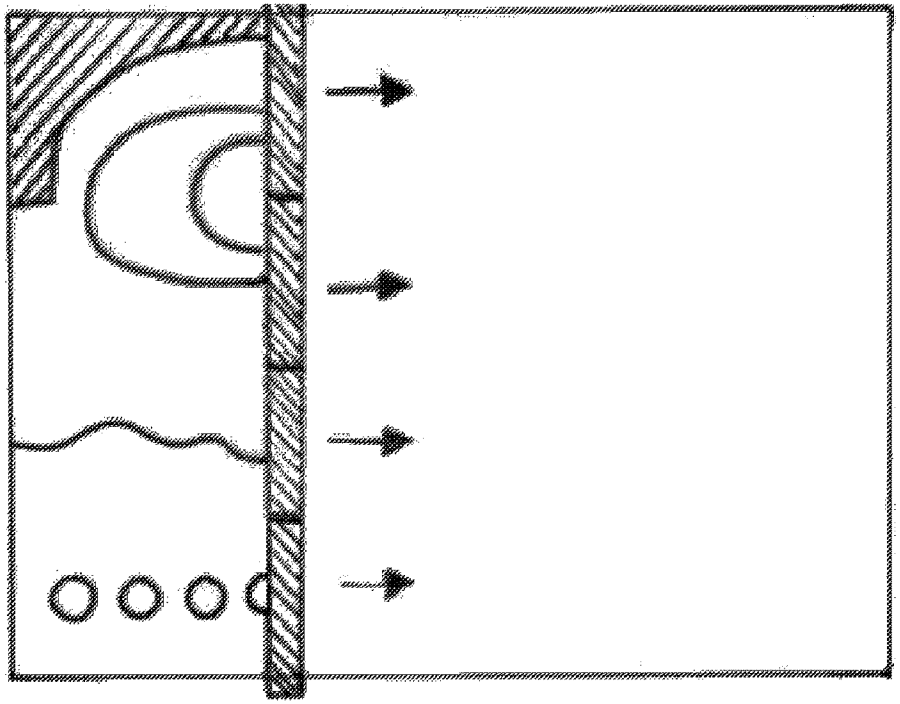
FIG. 4 shows an overview of an embodiment of the present invention wherein data from an audio file is captured and used to create a visual image.

In some embodiments, images comprising, an e-mail image, a Facebook page image, computer code and the like are used to generate audio output from the image or text on a page. In some embodiments, ASCII, or another standard format is used to generate audio output In some embodiments, geographic data captured by the user's location and other coordinates (for example, temporal coordinates) are used to generate audio output In some embodiments, a user listening to audio output of music presses a "Convert to Image" tab as a cursor scrolls in any direction, and pixel values are generated as the audio output plays the audio. (FIG. 4.)

In some embodiments, a visual image of the methods and systems of the present invention comprise an augmented reality visual image comprising, for example, a live direct or indirect view of a physical, real-world environment with elements that are augmented or supplemented by computer-generated sensory input comprising, for example, sound, video, smell, touch, graphics or GPS data. In other embodiments, a visual image of the present invention comprises mediated reality in which a view of reality is modified by a computer that, for example, enhances a user's perceptions of reality. In further embodiments, a virtual reality replaces the real world with a simulated reality. In certain embodiments augmentation is provided in real-time and in context with environmental elements. In particular embodiments, information about the surrounding real world of the user is interactive and digitally manipulable. In preferred embodiments, information about the environment and its objects may be overlaid on the real world, wherein the information is, for example, virtual or real information comprising real sensed or measured information such as electromagnetic radio waves overlaid in exact alignment with their actual position in space. In particularly preferred embodiments, methods and systems of the present invention comprise blended reality. In still further embodiments, augmented reality is communal blended reality wherein two or more users share an augmented reality.

Visual Image and Other Sources on the Web

In some embodiments, access to the user interface is controlled through an intermediary service provider, such as, for example, a website offering a secure connection following entry of confidential identification indicia, such as a user ID and password, which can be checked against the list of subscribers stored in memory. Upon confirmation, the user is given access to the site. Alternatively, the user could provide user information to sign into a server which is owned by the customer and, upon verification of the user by the customer server, the user can be linked to the user interface.

The user interface can be used by a variety of users to perform different functions, depending upon the type of user. Users generally access the user interface by using a remote computer, Internet appliance, or other electronic device with access to the Internet and capable of linking to an intermediary service provider operating a designated website and logging in. Alternatively, if elements of the system are located on site at a customer's location or as part of a customer intranet, the user can access the interface by using any device connected to the customer server and capable of interacting with the customer server or intranet to provide and receive information.

The user provides predetermined identification information (e.g., user type, email address, and password) which is then verified by checking a "central database" containing the names of all authorized users stored in computer memory. If the user is not found in the central database, access is not provided unless the "free trial" option has been selected, and then access is only provided to sample screens to enable the unknown user to evaluate the usefulness of the system. The central database containing the identification information of authorized users could be maintained by the intermediary service provider or by a customer. If the user is known (e.g., contained within the list of authorized users), the user will then be given access to an appropriate "home page" based on the type of user and the user ID which links to subscription information and preferences previously selected by the user. Thus, "home pages" with relevant information can be created for sponsors, submitters, and reviewers.

The login screen shown in allows the user to select the type of user interface to be accessed. Such a choice is convenient where an individual user fits into more than one category of user.

In some embodiments, the steps of the process are carried out by the intermediary service provider, and the audio composition is generated and accessible to the sponsor through the user interface.

In some embodiments, the systems and methods of the present invention are provided as an application service provider (ASP) (e.g., accessed by users within a web-based platform via a web browser across the Internet; is bundled into a network-type appliance and run within an institution or an intranet; is provided as a software package and used as a stand-alone system on a single computer); or may be an application for a mobile device.

Embodiments of the present invention provide systems (e.g., computer processors and computer memory) and methods for layering the above described modules on one image document displayed on a display screen. As shown in FIG. 1, in some embodiments, an image is displayed on the screen.

II. Sound Database Sources

In some embodiments, methods and systems of the present invention provide one or more sound databases comprising, for example, one or more musical genres including, for example, a classical music genre, a jazz genre, a rock and roll genre, a bluegrass genre, a country and western genre, a new age genre, a world music genre, an international music genre, an easy listening genre, a hip hop and/or rap genre and the like. In other embodiments, a sound database comprises sounds that a user has recorded or played and stored on a device of the application's methods and systems. In further embodiments, a sound database comprises one or more audio compositions generated by the methods and systems of the present invention. In particular embodiments, methods and systems of the present invention provide one or more templated sound libraries. In other embodiments, methods and systems of the present invention provide downloadable sound libraries from preferred artists and musicians. In some embodiments, sound libraries are provided as single instrument or multiple instrumental libraries, or vocal or choral sound libraries. In certain embodiments, templated sound libraries and supplemental sound libraries are available for user purchase. In further embodiments, sounds are generated from user-archived recordings of, for example, a device in use.

In some embodiments, methods and systems of the present invention comprise a diversity of pre-sets and patches comprising, for example, a thousand or more sounds, patterns audio snippets and the like. A user downloads their preferred sound selection based on their tastes with regard to genre, tempo, style, etc. In other embodiments, a user may have a selection of audio options for routing to the photo comprising either the entire audio selection, or portions of their audio selection, including user-generated, recorded and archived voices, songs, instrumentation and the like.

III. Audio Parameters

In some embodiments, methods and systems of the present invention comprise a plurality of blocks in a sound database comprising, for example, a note comprising a duration, pitch, volume or tonal content, or a plurality of notes comprising melody, harmony, rhythm, tempo, beat, swing, voice, key signature, key change, blue notes, intonation, temper, repetition, tracks, samples, loops, track number, counterpoint, dissonance, sound effects, reverberation, delay, chorus, flange, dynamics, chords, harmony, timbre, dissonance, dimension, motion, instrumentation, equalization, monophonic and stereophonic reproduction, equalization, compression and mute/unmute blocks. In certain embodiments, a plurality of blocks in a sound database comprise a recorded analog or digital sound, an analog or digital sound selected from a recording database, a digital sound selected from a web-based database, or a user-edited analog or digital sound. In preferred embodiments, one or more of a plurality of blocks in a sound database is assigned a tag, for example a numeric tag, an alphabetic tag, a binary tag, a barcode tag, a digital tag, a frequency tag, or other retrievable identifier. Methods and systems of the present invention may comprise a diversity of sound blocks comprising, for example, tones, riffs, samples, loops, styles, sound effects, sound illusions, just noticeable audio differences, ambiguous audio content, instrument sounds, vocal sounds, choral sounds, orchestral sounds, chamber music sounds, solo sounds, and other sounds. In certain embodiments, methods and systems of the present invention further comprise one or more pitch or low frequency oscillators, volume amplifiers, tonal filters, graphic and/or parametric equalizers, compressors, gates, attenuators, feedback circuits, and/or components configured for flanging, mixing, phasing, reverberation, attack, decay, sustain, release, panning, vibrato, and tremolo sound generation and audio composition.

In some embodiments, methods and systems of the present invention provide multiple tracks. As used herein, a "track" is a component of a composition, for example, a saxophone line in a recording would be referred to as the saxophone track. the present invention provides user options for the addition of further tracks, with audio output assigned to participate within a chosen track.

In some embodiments, methods and systems of the present invention provide a system that analyzes an image and assigns an entire song to be played together with a specific mix and effect. As used herein, "mixing" is the process of summing individual tracks and components of a composition into a single audio output, for example, a single musical composition. Establishing volume, equalization, and panning are exemplary features that are addressed when mixing. As used herein, "effects" provide artificially enhanced sounds including, for example, reverberation, echo, flanging, chorus and the like. Combined values of cursor scans may be actively user-programmed or passively automated at user option to generate the tempo of an audio output or song by, for example, changing the pitch, selecting the tone, or any other parameter of the audio output. For example, if a pre-set combined numeric cursor value is 423, a measured value of 420-430 changes the pitch by ½ step, or adds an echo to the audio output. In particular embodiments, a user may edit parameters of modulators such as the depth of a low frequency oscillator (LFO). An example of an LFO is provided by a voice speaking through a fan. The voice sounds normal when the fan is off, and is modulated by the speed of the fan when the fan is engaged. For example, a visual image may direct the speed of the LFO, and the pixel values may modulate the parameters of the LFO.

IV. User Interfaces

In some embodiments, methods and systems of the present invention provide at least one user interface comprising, for example, a display screen interface, an alphanumeric keyboard, a music notation keyboard, a tactile interface, a vibration transducer, a motion transducer, a location interface, or a or a voice recognition interface. In preferred embodiments, a user interface comprises a visual image display screen. In certain embodiments a visual image display screen comprises at least one cursor that scans the visual image for user selected input relating to one or more visual image regions of a displayed visual image. In other embodiments, methods and systems receive a user's input relating to the number, orientation, shape, dimensions, color, rate of travel, direction of travel, steerability and image resolution of the at least one video image cursor. For example, a cursor may scan left to right, right to left, top to bottom, bottom to top, inside to out, outside to in, diagonally, or any other user-selected cursor pathway in selecting regions and sub-regions of a displayed video image for generation of an audio composition. In further embodiments, a user serially selects and modifies a visual region or sub-region comprising, for example, one or more pixels, and scrolls through one or more regions and sub-regions while a cursor is inactive. Upon activation of a cursor one or more regions or sub-regions may then be repeated or looped until the visual image to audio block conversion and programming parameters are acceptable to the user.

In specific embodiments, a user interface provides one or more ports for user input of audio elements in real time, before and/or after visual to audio conversion, comprising for example, voice input, tapping, shaking, spinning, juggling, instrumental input, whistling, singing and the like. In particularly preferred embodiments, a user uses a user interface to select the dimensions of a region of a visual image, dimensions of a sub-region of a displayed visual image, and/or the visual content (e.g., outline) of a displayed region or sub-region of a displayed visual image. In still further embodiments, a user interface provides user input for two or more visual image sources to be combined and edited according to a user's preferences In some embodiments, methods and systems of the present invention provide audio outputs from video images in real time. In particular embodiments, the methods and systems analyze data from multiple cursors from the same source image, and deliver simultaneously streaming audio output. In certain embodiments, cursors move in synchronicity opposite from one another, or at random, and/or in any direction. In other embodiments, the user selects preset cursor values. In further embodiments, cursor performance is user-programmable. In certain embodiments, user voice activates any cursor function using voice directions. For example, a user may specify cursor range, direction, and analysis editing including how many seconds ahead of the cursor the methods and systems of the present invention are analyzing the video input in real time. If a cursor is moving left to right, then a user may select the amount of time ahead of the cursor the pixel analysis is acquiring visual image data, and audio output in real time is being assigned.

In some embodiments, a user selects an audio output length. For example, a single image may generate an audio output lasting 1 minute, or an audio output lasting 5 minutes. Thus, one image may generate an audio output that is 1 minute long or 5 minutes long. Using the user interface, a user selects the number of tracks, the number of voices or sounds for each track, the number of notes to be used, the tonality or atonality of one or more tracks, and the number of notes simultaneously generated. In certain embodiments, the user display provides recognizable patterns, for example, if identical twins are present in an image, then the cursor directs similar audio output over the image of each twin.

V. Audio Composition Generation

The present invention provides a method for audio composition generation using at least one computer system comprising a processor, a user interface, a visual image display screen, a sound database, an audio composition computer program on a computer readable medium configured to receive input from the visual image display screen to access and select audio blocks in a sound database to generate an audio composition, and an audio system, comprising displaying a visual image on the visual image display screen, receiving a user's input relating to one or more audio parameters, scanning the visual image to identify a plurality of visual image regions, selecting and assembling a plurality of blocks in the sound database based on the visual image regions and the user's input of the one or more audio parameters, and generating an audio composition based on selecting and assembling the plurality of blocks in the sound database using the audio system. In some embodiments generating an audio composition based on selecting and assembling a plurality of blocks in a sound database using an audio system takes place in real time i.e., as the displayed visual image is being scanned by, for example, one or more cursor's with a user's input.

In further embodiments, the selecting and assembling a plurality of blocks from a sound database based on visual image regions and a user's input of one or more audio parameters comprises at least one user-determined filter to pass and/or to not pass tags of one or more sound database blocks to an auditory composition. In some embodiments, regions and sub-regions of a displayed visual image are selected by default. In other embodiments, regions and sub-regions of a displayed visual image are selected by a user from a pre-programmed menu of options. In another embodiment, regions and sub-regions of a displayed visual image are selected by a combination of a pre-programmed menu and input of user preferences in real time or after entry of said preferences, for example, generating an audio composition takes place after scanning a displayed visual image. In specific embodiments, a user isolates a region or sub-region and selects its corresponding tagged block or blocks to loop a pre-determined number of cycles, or repetitively until a preferred audio composition is generated. In other embodiments, a user interface is used to select serial sub-regions to generate looped and/or repetitive blocks in order or in parallel.

In some embodiments, the methods and systems of the present invention receive a user's input relating to the compatibility, alignment and transposition of a plurality of passed blocks from the sound database to an audio composition to comprise, for example, a user's preferences for intonation, tempo, dissonance and consonance, timbre, color, harmony, tempo and temper. In yet further embodiments, the methods and systems receive a user's input relating to generating an audio composition using an audio system including, for example, a stereo system, a quadrophonic system, a public address system, speakers, earbuds and earphones.

In some embodiments, a region or sub-region of a displayed visual image may correspond to a particular musical instrument or combination of musical instruments. The user may alter the instruments assigned to each region in real time. For example, a top region or regions of a displayed visual image may be selected to provide rhythm and drum patterns determined by user input with regard to pixel values. Other regions may be selected by the user to provide, for example, bass components, tenor components, alto components and/or soprano components for voice or instrument. By assigning one or more user-selected tagged audio blocks to one or more user-selected audio regions, a user may determine the audio value or meaning of a visual image region or sub-region comprising, for example, one or more visual pixels. As one or more cursors scan a displayed visual image as directed by a user, the combination of a displayed visual image and a user's selection of visual image regions coupled with a user's selection of audio parameters, for example, tagged audio blocks in an audio database, direct generation of an audio composition. In preferred embodiments, any user-selected region of any displayed visual image may be selected for generation of an audio composition by any user-selected audio parameters from an audio database. In some embodiments, the audio composition is music. In other embodiments, the audio composition is a non-musical audio composition, for example, a warning audio composition, an advertising audio composition, an instructional audio composition, a spoken word audio composition, an audio composition that corresponds to a visual mark of product origin, or other generation of an audio composition from a digital visual image with user input in, for example, real time.

In some embodiments, methods and systems of the present invention provide one or more hardware or software modulators, oscillators (for example, low pitch oscillators), volume, amplifiers, frequency and pitch filters, one or more digital and analog turntables, a MIDI device, and/or other audio conditioning components. In specific embodiments, audio modulators are connected to the methods and systems of the present invention by wire, cable, or by wireless communication including for example, Bluetooth, IR, radio, optical and similar communication media. In particular embodiments, audio components provide audio delay, chorus, flange, panning, reverberation, crescendo, decrescendo and the like. In preferred embodiments, methods and systems provide user selected voice, touch, movement, shaking, blowing into a microphone, physical and interface commands that direct audio composition. In certain embodiments, user input comprises tapping or drumming a device or display screen for entry of user rhythm preferences. In other embodiments, tapping force corresponds to volume of, for example, a drum or cymbal in a generated audio composition.

Figure 5:
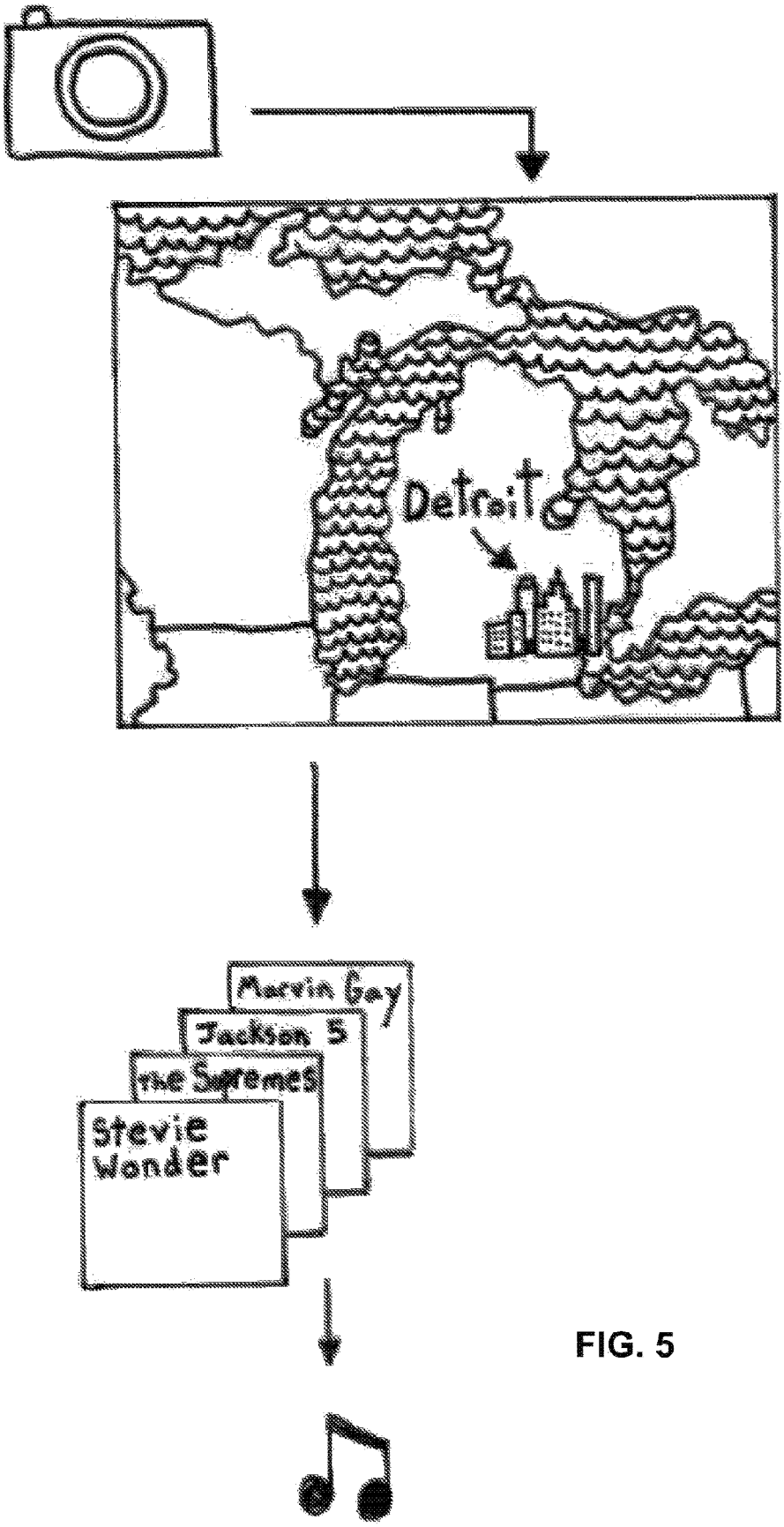
FIG. 5 shows an overview of an embodiment of the present invention wherein a user driving through Detroit, Mich. captures a visual image with a digital camera with an Iphone, and a geo sensor triggers an audio output of music in the style of renowned Detroit and Motown artists in real time.

In some embodiments the methods and systems of the present invention comprise a global positioning system (GPS) that selects audio parameters in accordance with the geographic coordinates of a visual image to audio composition device or application. For example, in Nashville, Tenn. a country and western audio composition is generated, in Detroit, Mich. a Motown audio composition is generated, in Seattle, Wash. a grunge audio composition is generated. In particular embodiments, the rate of travel of a device or application comprising the methods and systems of the present invention directs the rhythm, tempo and beat of a generated audio composition. In other embodiments, traveling on a specific street or climbing up a mountain will generate a certain audio composition. In other embodiments, methods and systems receive user input of a user's movement during video game play, walking, running, riding or flying in real time, and/or after an activity is completed. (FIG. 5.)

Figure 6:
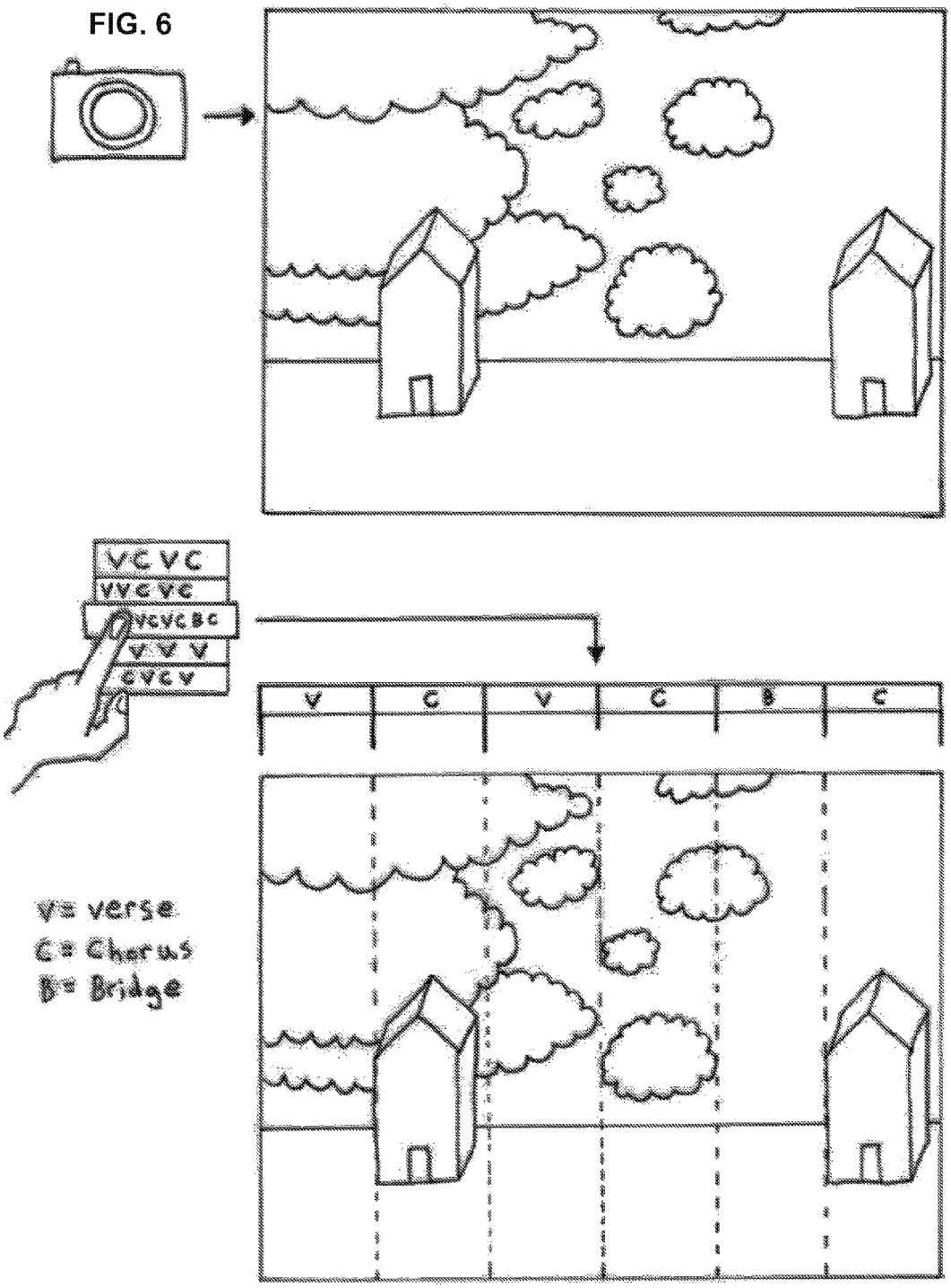
FIG. 6 shows an overview of an embodiment of the present invention wherein a songwriter captures an image of 2 barns in a field, and selects a popular song format that directs generation of a song structure to be completed with lyrics.

In some embodiments, the methods and systems of the present invention comprise analysis of an image to direct song formats. In particular embodiments, methods and systems of the present invention survey an entire image or input source. Based on the image structure of the source, one of a pre-determined number of song formats is selected to assign a user-selected audio output. In particular embodiments, song formats comprise VCVC, VVCVC, CVCV, VCVCBC, and VVV formats that dominate popular media based on Pixel structure to create the audio output. (FIG. 6.)

Figure 7:
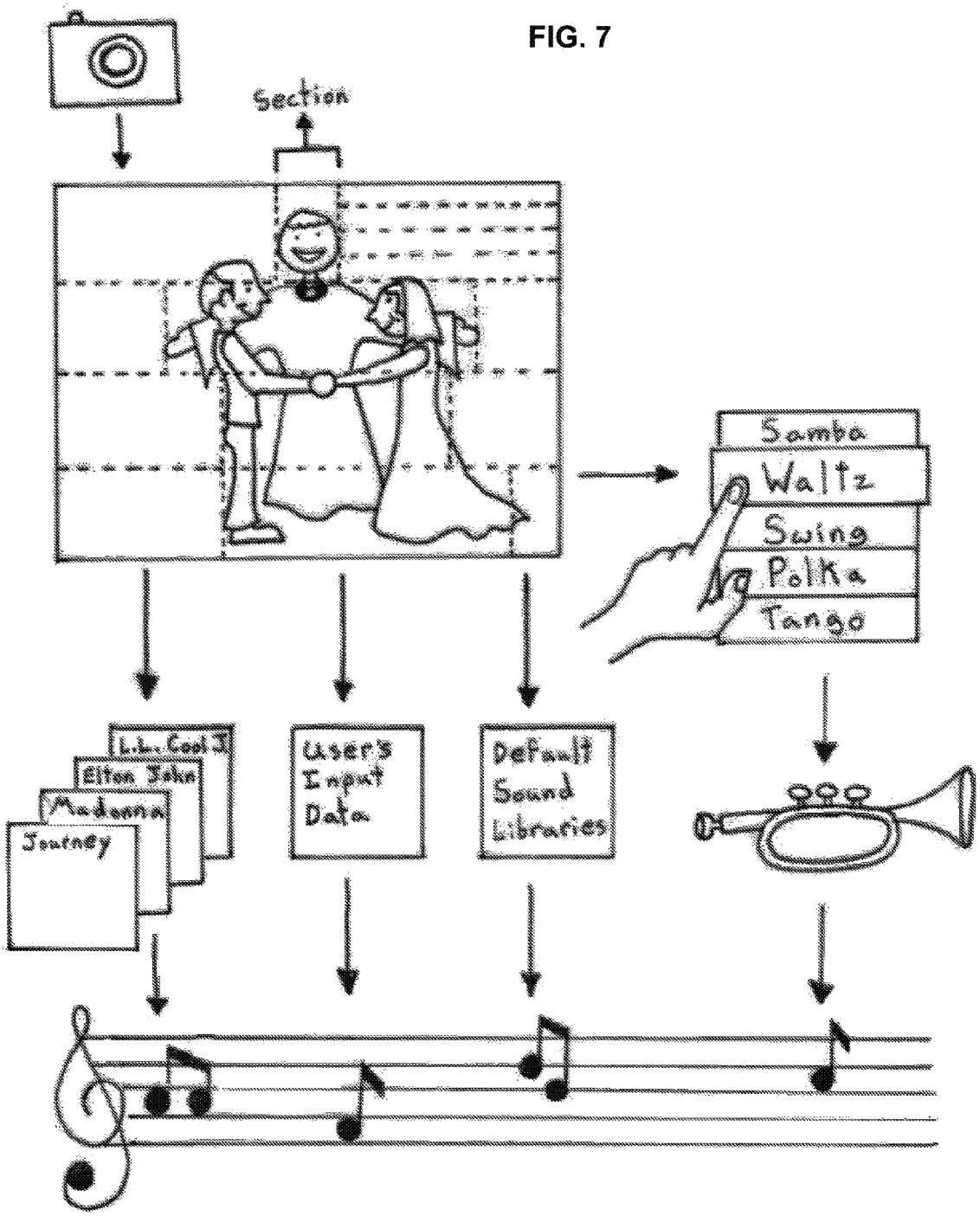
FIG. 7 shows an overview of an embodiment of the present invention wherein a wedding photographer captures an image of a bride and groom at the altar. When selecting a framework using the methods and systems of the present invention, each selected region denoted herein by dotted lines is selected and edited by the photographer. The photographer selects a waltz rhythm, popular tunes, the vows that were recorded, and instruments from a default sound library for production of an audio output. Thereafter, the photographer selects addition of a trumpet track.

In some embodiments, the methods and systems of the present invention analyze audio attributes of the user's previously archived audio outputs, and select sounds, rhythms and notes based on the analysis to direct pixel analysis and user options for audio production from a newly captured image. In particular embodiments, this option may be globally or locally selected on the image by the user on their interface. (FIG. 7.)

In some embodiments, the methods and systems of the present invention comprise an optional learning module that uses more than one pixel to generate an infinite amount of possible audio outputs while analyzing image content. For example, in 2 successive columns or arrangements of image pixels, a Red pixel has a value of 234 and a successive Red pixel has a value of 120. In particular embodiments, the two values may be added to determine another value to generate an audio attribute. In turn, the 2 values may be subtracted to generate another attribute. As more pixels and their values are added, the differentials used to generate the audio output, or any kind of output, become more useful. As the programmed learning occurs over time, the values contribute to predictability that the user comes to expect from the original source image or other source. (FIGS. 2 and 3.)

In some embodiments, the methods and systems of the present invention provide user options for framework editing. As used herein, a "framework is a collection of blocks, regions, sub-regions, and cursor tracks in a visual image. Once an image has been captured, a default framework of all tracks, blocks and regions may be displayed for subsequent editing. In particular embodiments, specific image regions and audio blocks are selected by a user to edit audio pitch, volume, tone, modulation or other pixel value and audio output parameters. In some embodiments, the methods and systems of the present invention provide rhythms generated on the basis of pixel values, the relationship between the pixel values, and/or one or more of the R, G, B values. In certain embodiments, percussion programming is provided with a diversity of time signatures. Analysis of the entire image, and relationships between the pixels, generates the time signature used in the audio output.

In some embodiments, the methods and systems of the present invention provide polyphonic composition comprising the number of sound generators (for example, oscillators and voices) that may be used at any given time. An unlimited number of sounds may be played at one time, limited only by memory storage capacity of the present invention's methods and systems. In certain embodiments, the methods and systems of the present invention tune instruments and recorded voices to a user's voice.

VI. Audio Composition Storage and Distribution

In some embodiments, the audio composition output is stored on computer readable medium (e.g., DVDs, CDs, hard disk drives, magnetic tape and servers for streaming media over networks). In other embodiments, the auditory output is stored on computer memory or a computer memory device.

In some embodiments, the computer system comprises computer memory or a computer memory device and a computer processor. In some embodiments, the computer memory (or computer memory device) and computer processor are part of the same computer. In other embodiments, the computer memory device or computer memory are located on one computer and the computer processor is located on a different computer. In some embodiments, the computer memory is connected to the computer processor through the Internet or World Wide Web. In some embodiments, the computer memory is on a computer readable medium (e.g., floppy disk, hard disk, compact disk, DVD, etc). In other embodiments, the computer memory (or computer memory device) and computer processor are connected via a local network or intranet.

In some embodiments, a processor comprises multiple processors in communication with each other for carrying out the various processing tasks required to reach the desired end result. For example, the computer of an intermediary service provider may perform some processing and the computer of a customer linked to the intermediary service provider may perform other processing.

In some embodiments, the computer system further comprises computer readable medium with the auditory output stored thereon. In further embodiments, the computer system comprises the computer memory, computer processor, and the peer review application is located on the computer memory, and the computer processor is able to read the auditory output application from the computer memory (e.g., ROM or other computer memory) and perform a set of steps according to auditory output application. In certain embodiments, the computer system may comprise a computer memory device, a computer processor, an interactive device (e.g., keyboard, mouse, voice recognition system), and a display system (e.g., monitor, speaker system, etc.).

In still other embodiments, the method further comprises the step of transmitting the second information stream to a computer of a viewer. In other embodiments, the method further comprises the step of receiving feedback information (e.g., questions or comments) from a viewer.

In some embodiments the systems and methods also provide a hardcopy or electronic translation of the dialogue in a scripted form. The systems and methods of the present invention may be used to transmit and receive synchronized audio, video, timecode, and text over a communication network.

In some embodiments, the information is encrypted and decrypted to provide anti-piracy or theft of the material.

In some embodiments, audio compositions generated by the methods and systems of the present invention are stored on a computer readable medium, stored in a sound database (for example, a sound database of the present invention), stored on a web-based medium, edited, privately shared, publicly shared, available for sale, license, or conversion to a visual image. In certain embodiments, an audio composition computer program on a computer readable medium configured to receive input from a user's preference with regard to a visual image display screen and from a user's preferences with regard to a sound database to generate an audio composition is downloadable to a mobile device, a phone, a tablet, a computer, a device configured to receive Mp3 files, or other digital archive or source. For example, when a user is satisfied with a final generated audio composition the user may select the audio composition to be saved to a phone or iPhone in an Mp3 format. Optionally, a user may elect to upload an audio composition of the present invention to a parent site, to the world wide web, or to a cloud location. In some embodiments, the parent site receives a displayed visual image, and user-selected visual image regions and pixel audio values used to generate an audio composition, but not the audio composition itself.

In some embodiments, visual images and audio compositions generated by the methods and systems of the present invention may be sold or licensed to visual and audio content vendors, including for example, vendors of film, television, video and audio games, film scores, radio, social media, sports vendors, and/or other commercial distributors. In preferred embodiments, audio compositions may be available for direct purchase from, for example, a playlist or archive of downloadable audio and video compositions. In certain embodiments, audio compositions of the present invention may be entered into audio and/or video competition. In specific embodiments, the methods and systems provide user input of one or more pre-set criteria for archiving a generated audio composition for offline review, editing, or deletion. In particular embodiments, a generated audio composition or elements thereof are archived in an audio database for assignment of block and tag identifiers for use in generation of further audio compositions. In other embodiments, an audio composition is scanned for conversion to generate a visual image for display and, optionally, further cycles of visual to audio and audio to visual conversion to generate a family or lineage of audio and visual compositions related to one another by shared original sources, shared user inputs, and shared one or more user guided algorithms. In particularly preferred embodiments, the methods and systems of the present invention receive user input for off-line modulation and editing of a generated audio composition. In other embodiments, the methods and systems of the present invention provide an audio port for user entry of vocal dubbing in an original or modulated voice, or vocal content superimposed on a generated audio composition comprising, for example, singing, recitation of prose, poetry, instructions, liminal and subliminal content and the like.

In some embodiments, generated audio compositions using the methods and systems of the present invention provide personal entertainment and/or public entertainment. In certain embodiments, the users and consumers of audio compositions generated by the present methods and systems are amateur users and consumers. In other embodiments, the users and consumers are professional users and consumers comprising, for example, professional musicians, agents, managers, venues, sound reproduction commercial entities, radio programmers, distributors, and advertisers. In further embodiments, the audio compositions find use in providing ambient audio content in commercial settings, medical settings, educational settings, military settings and the like. In still further embodiments, the audio compositions find use in communication of an encoded or encrypted message. In particular embodiments, the methods and system generate an audio composition that corresponds to, and optionally accompanies, for example, a Flipboard news story. In other embodiments, the methods and systems comprise object, character and personal recognition modules for user entry of one or more displayed visual images, and generation of an audio composition comprising audio parameters linked to recognized objects, characters and persons.

Example 1

A photographer is capturing images of a wedding using different lenses and light sources to generate a memorable re-creation of the day. (FIG. 7.) After returning to the studio, the photographer transfers imagery from the source device, for example, a digital camera (or scans the images from an analog camera), and begins typical edits from the shoot. While adjusting the color and balance of the image, the photographer also selects the regions and sub-regions of each image to optimize the audio playback of the image. While selecting the regions, the photographer selects a genre of music for a specific image. After selecting the genre, the photographer compares different rhythms and grooves. As used herein, a "groove" is stylistic way a certain rhythm is performed. The photographer then selects the sounds of the instrumentation, and ends by selecting a lead instrument. During the ceremony the photographer captured audio playback of the vows, and has incorporated them into the audio playback regions of the images. The photographer experiments with a sound that might work a little better with the color of the bride's dress, or the effects of the setting sun in the background. After making numerous selections, and testing audio outputs vs. visual inputs, the photographer provides a finished product.

Example 2

Figure 8:
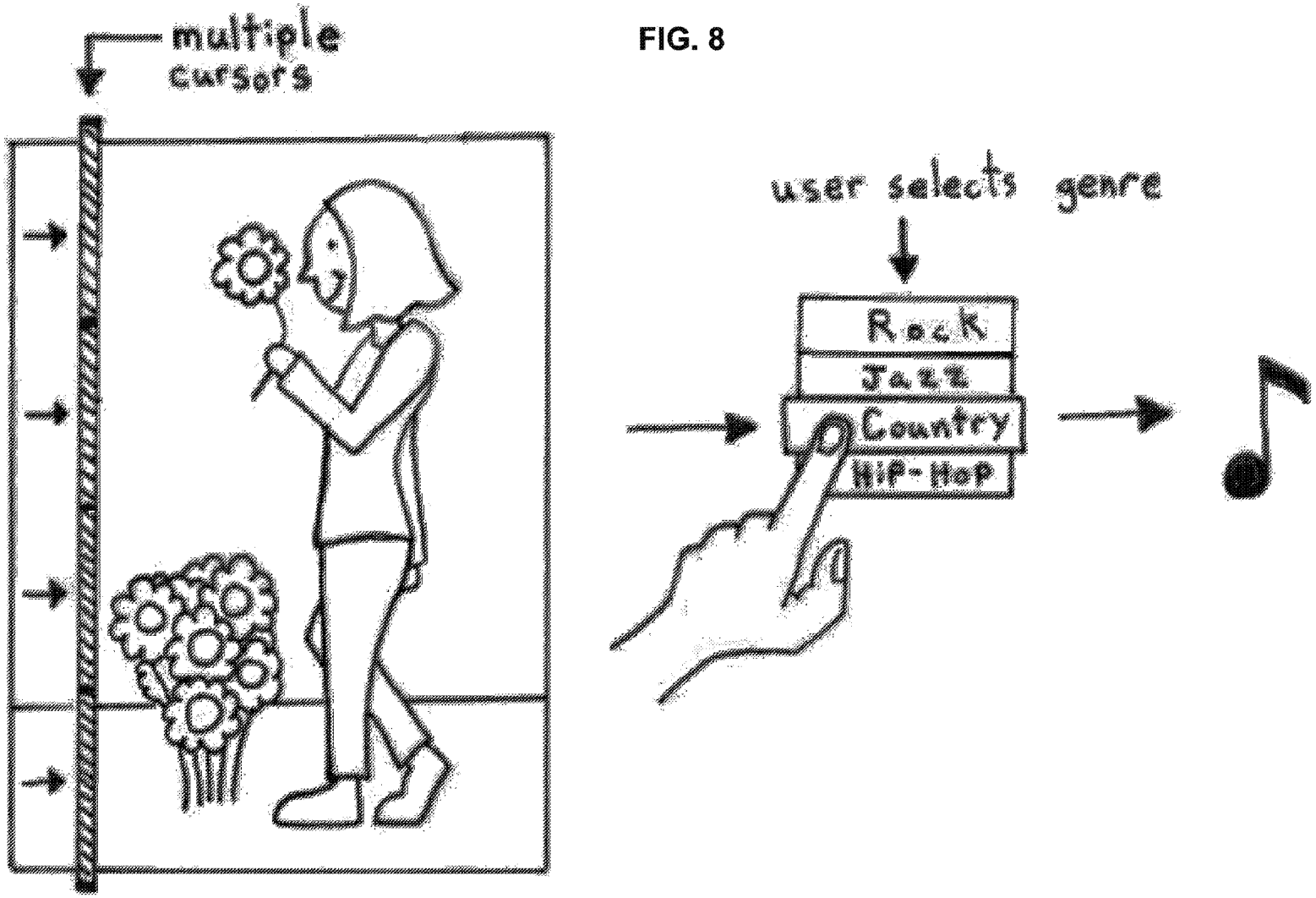
FIG. 8 shows an overview of an embodiment of the present invention wherein an image of a grandmother is captured. The user selects multiple cursors to scan the image left-to-right, and selects country music for delivery of an audio composition in real time.
Figure 9:
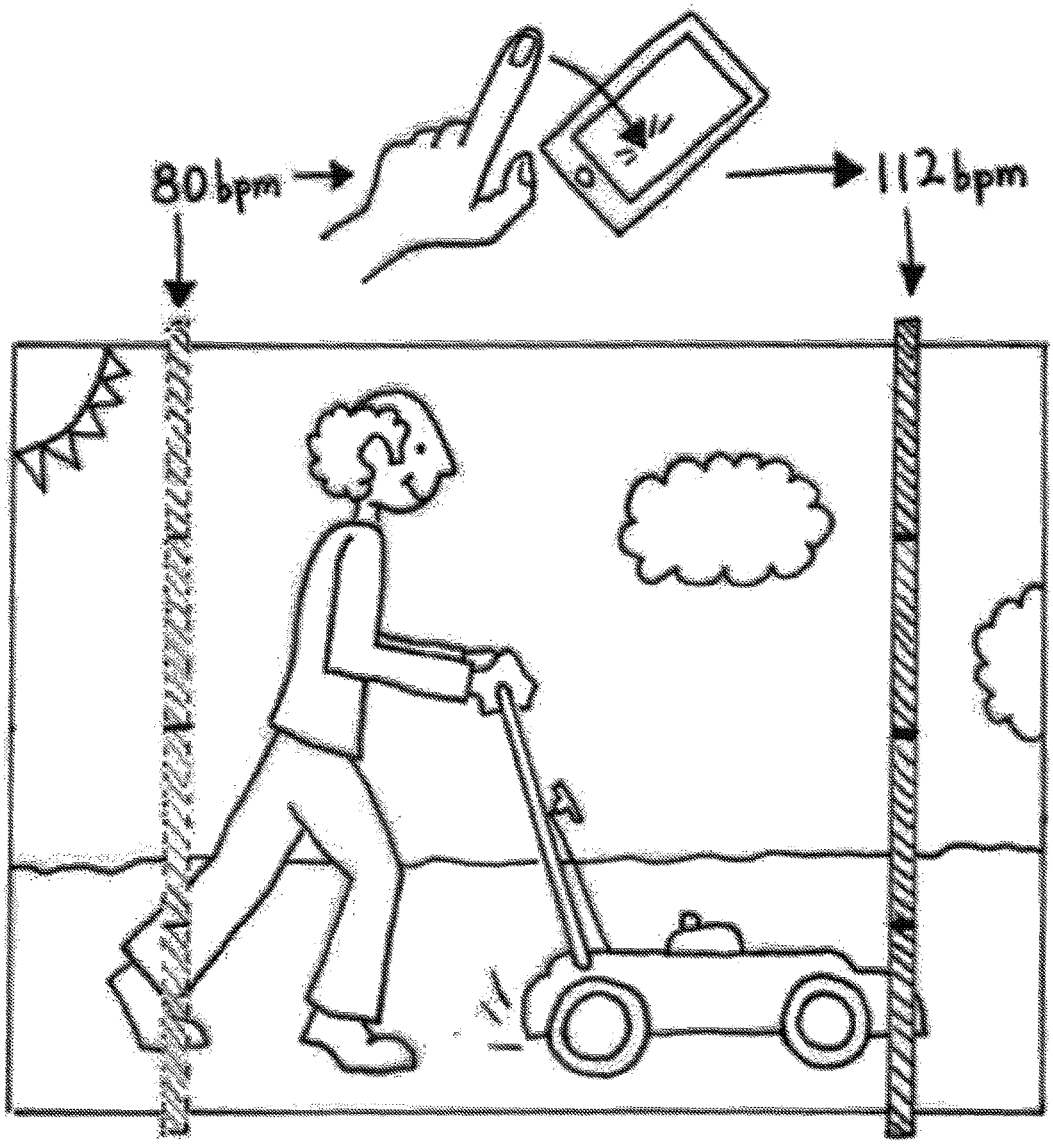
FIG. 9 shows an overview of an embodiment of the present invention wherein an image of a grandfather mowing a lawn is captured. The user taps the screen faster that the speed of the generated audio composition, and the tempo of the audio composition increases in correspondence to the user's tapping.

A youngster is staying with Grandma and Grandpa for the weekend. Using her Iphone, she takes a picture of Grandma picking flowers in front of the barn, and immediately selects the country music blocks of sound that she opted to install at the time of the download. (FIG. 8.) Next she has an image of Grandma doing the dishes to a country music track. Grandpa is out working on the lawn and the young girl takes a picture of him on his mower. (FIG. 9.) She quickly applies the same country music sound set, but a different tune is presented because the image, pixel values and colors are different. Because Grandpa is on the mower and moving a little faster, using her finger the youngster speeds the tempo by tapping on the display, and the music increases in tempo in synchronicity with the rhythm of her tap. She watches the cursors, which in this instant are moving left to right across the display, increase in speed. Once she has generated a preferred tempo, she saves her work, and posts the visual image and audio output to social media sites for her friends and family to view.

Example 3

Figure 10:
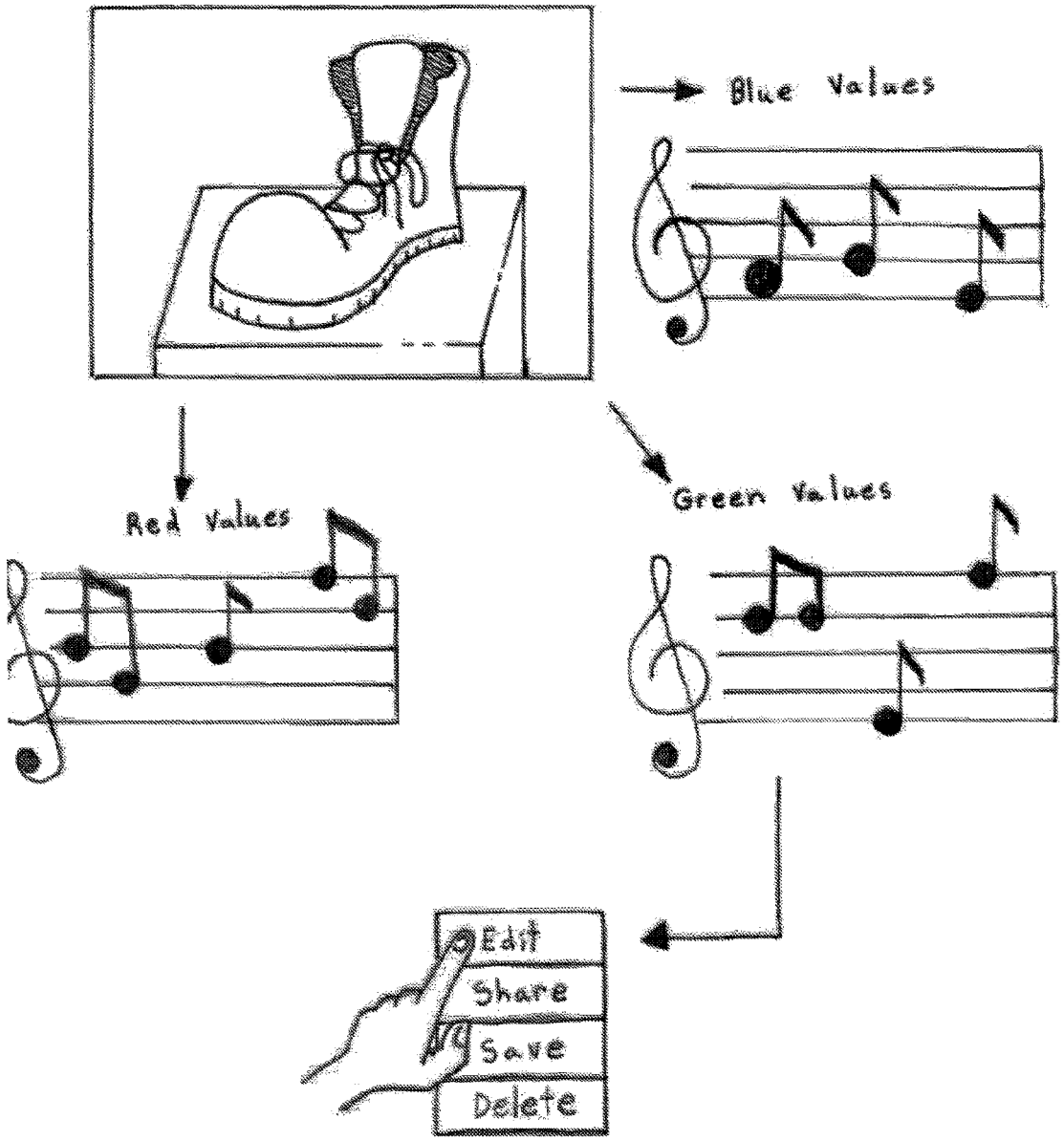
FIG. 10 shows an overview of an embodiment of the present invention wherein an advertising manager captures an image of a product for display, uses the methods and systems of the present invention to generate 3 musical audio compositions, and forwards the compositions to her supervisor for the supervisor's selected editions.

An advertising account manager working on an online promotion for a shoe company captures an image of a shoe, and downloads techno-electronic blocks of sounds that are provided in a downloaded application of the present invention. (FIG. 10.) A first image is captured and a musical audio composition begins to play. Using a video image interface and cursor, the manager removes one shoe from the image, and rotates a second shoe ninety degrees. The manager then captures a second image and an audio composition is generated in real time. Because each of the Red, Green, and Blue pixel values generates a unique and different musical audio output, each acquired image gives the account manager 3 choices of music. This process is repeated until the manager's sounds, rhythms and effects are matched with the manager's wishes to express the spirit and value of the shoe, and/or pair of shoes. When the manager's visual image and accompanying audio compositions are forwarded to a central office, an executive enters visual and audio edits of her preference. The executive refines selection of regions of interest and their audio correlates, increases the tempo, adds hard rock to the mix of sounds, and completes the advertising product.

Example 4

Figure 11:
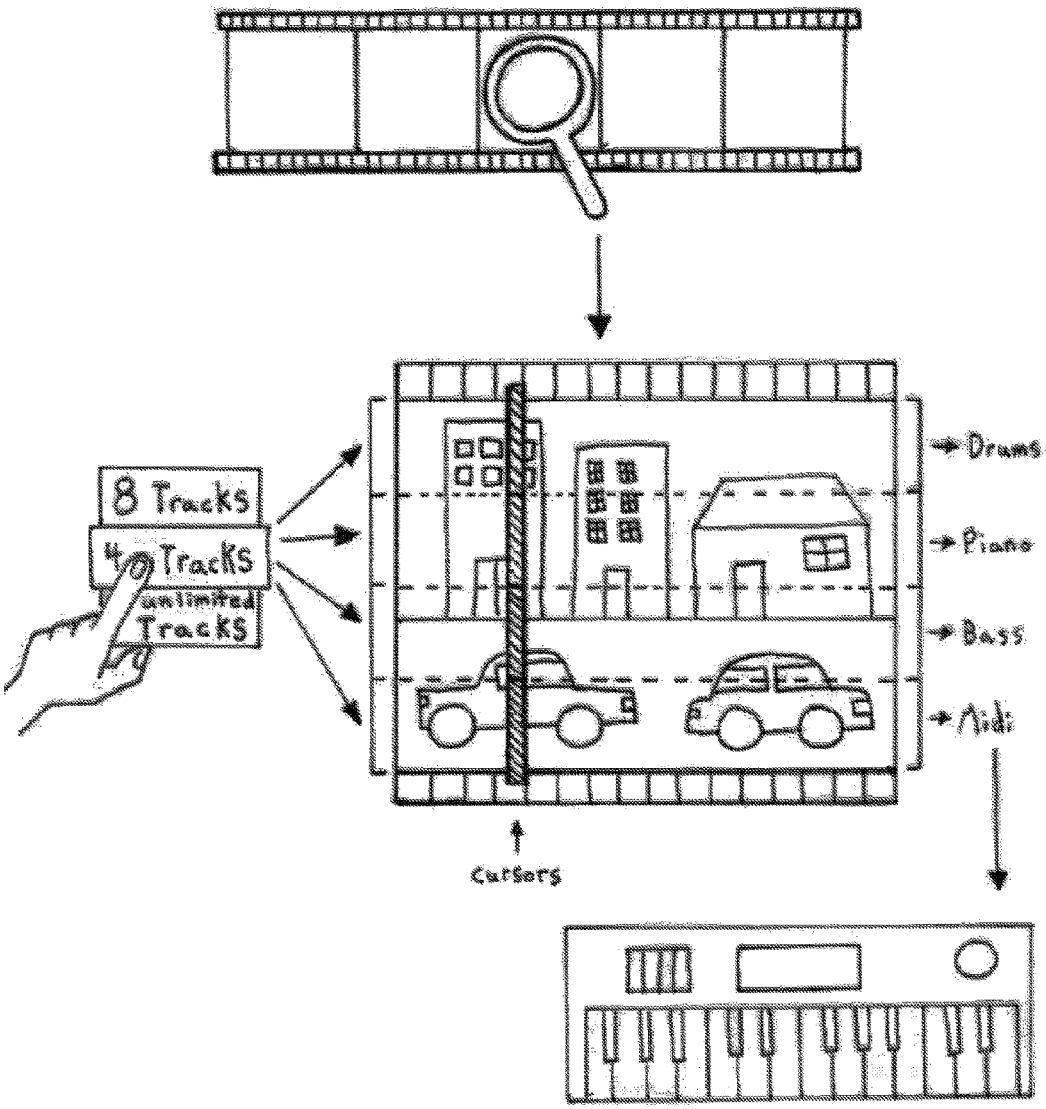
FIG. 11 shows an overview of an embodiment of the present invention wherein a cinema director is filming a production, and wishes to generate a musical audio composition to accompany a traffic scene. The director activates methods and systems of the present invention, selects 4 tracks comprising 4 unique instruments comprising one instrument that sends MIDI signals to a keyboard, and generates background music for a filmed production.

A director is shooting a feature film and seeks a soundtrack, but is short on budget and ideas. She and a film editor download an application of the present invention, select visual regions of interest and audio parameter sound blocks, and generates a first version of an audio composition cinema soundtrack. The director and film editor place rock sounds in a city traffic scene and new age sounds in valley scenes, but struggle with preferred instrumentation. A composer is hired who generates numerous options for visual image guided audio compositions that are triggered by the director's and editor's first version instrument selections. The composer generates and performs additional audio components using a MIDI installed protocol, that in turn triggers further sounds from the composer's computer library and keyboards to arrive at a finished product. (FIG. 11.)

Example 5

Figure 12:
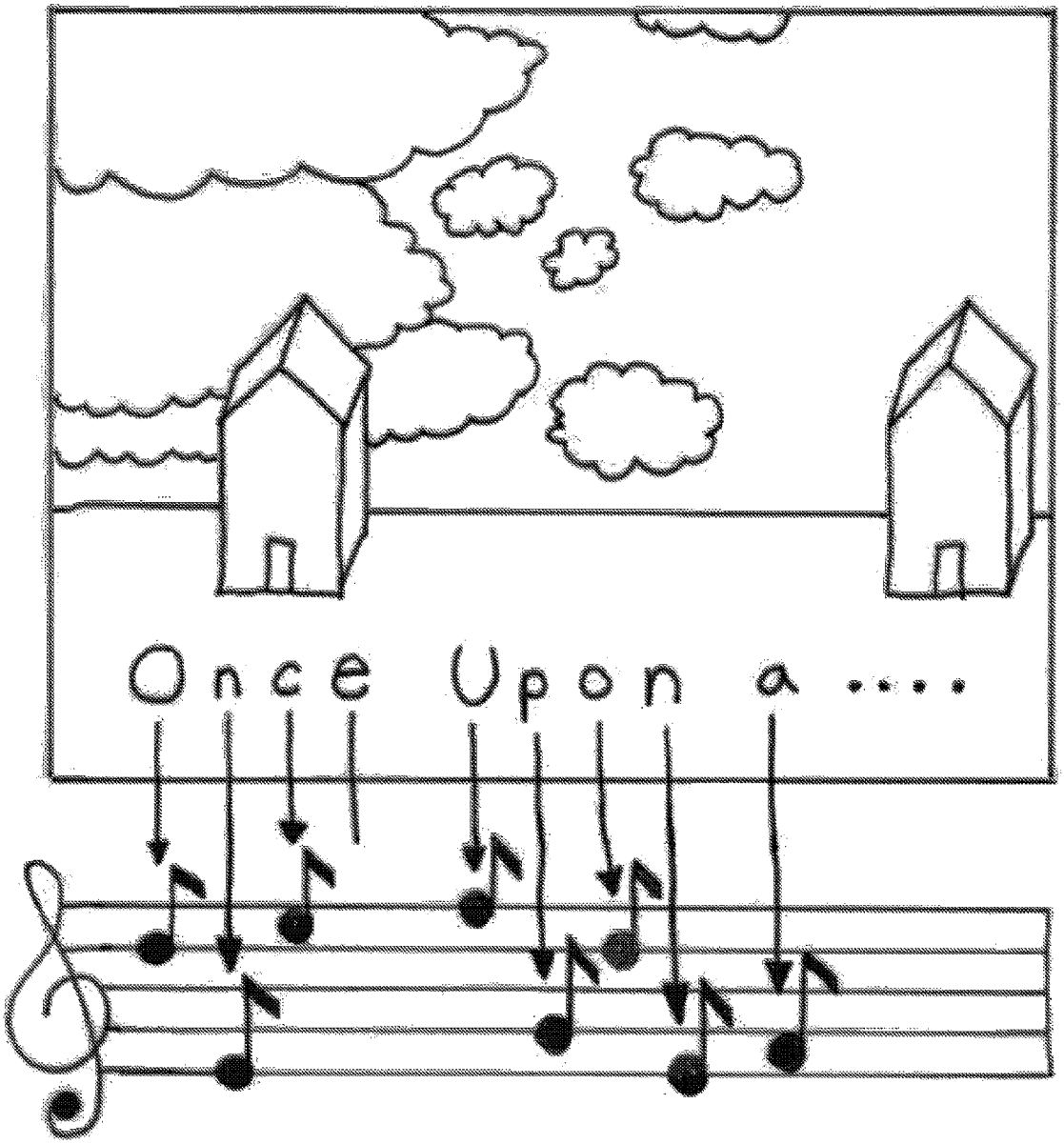
FIG. 12 shows an overview of an embodiment of the present invention wherein a digital book is opened and the letters of the alphabet, punctuation, numbers and characters are used by the methods and systems of the present invention to compose a melody.

In this example, audio output is generated from the value of a musical note derived from the value of text (for example, a book or written text) according to its ASCII specification, or any other specification. For example, the clause "Once upon a time . . . " may be used to generate 9 notes on a musical staff: the O's are an E note, the n's are a C note, the C is a D note, the E is a B note, the U is an A note, the P is a G note, and the A is an F note. (FIG. 12.) Accordingly, using the methods and systems of the present invention, a user may generate a complete orchestral arrangement from the video text of, for example, a digital book. Optionally, a user may select which letter corresponds to each musical note. Different letters may be applied to the same note depending on which musical scales are used as the algorithm. The methods and systems of the present invention provide diverse scales for user editing or preference.

Example 6

A songwriter is stymied and requires a creative trigger. The musician captures an image, and scans the pixel values of the entire picture. From the structure of the source, a pre-determined number of song formats may be selected to generate an audio output. The user scrolls through a listing of common formats:

Verse (v) - Chorus (c) - Verse - Chorus
Verse - Verse - Chorus - Verse - Chorus
Chorus - Verse - Chorus - Verse -
Verse - Chorus - Verse - Chorus - Bridge (b) - Chorus
Verse - Verse - Verse The user selects a preferred format based on pixel structure and creates an audio output. (FIG. 6.) The user continues to examine the list toggling between her two favorites, and finally selects one. The writer's block has been eliminated, and she begins writing lyrics to her song. Once she captures the format, she selects the sound blocks she will use for each image region and track. Upon completion of her audio selection, she selects a microphone input to record her voice. She now has a completed auditory composition and, if desired, is ready to take her creation to the studio.

Example 7

A user is driving through Detroit and captures an image. A geographic sensor in the methods and systems of the present invention identifies the location of the user, and provides the sounds of Motown as an audio output. (FIG. 5.)

Example 8

Figure 13:
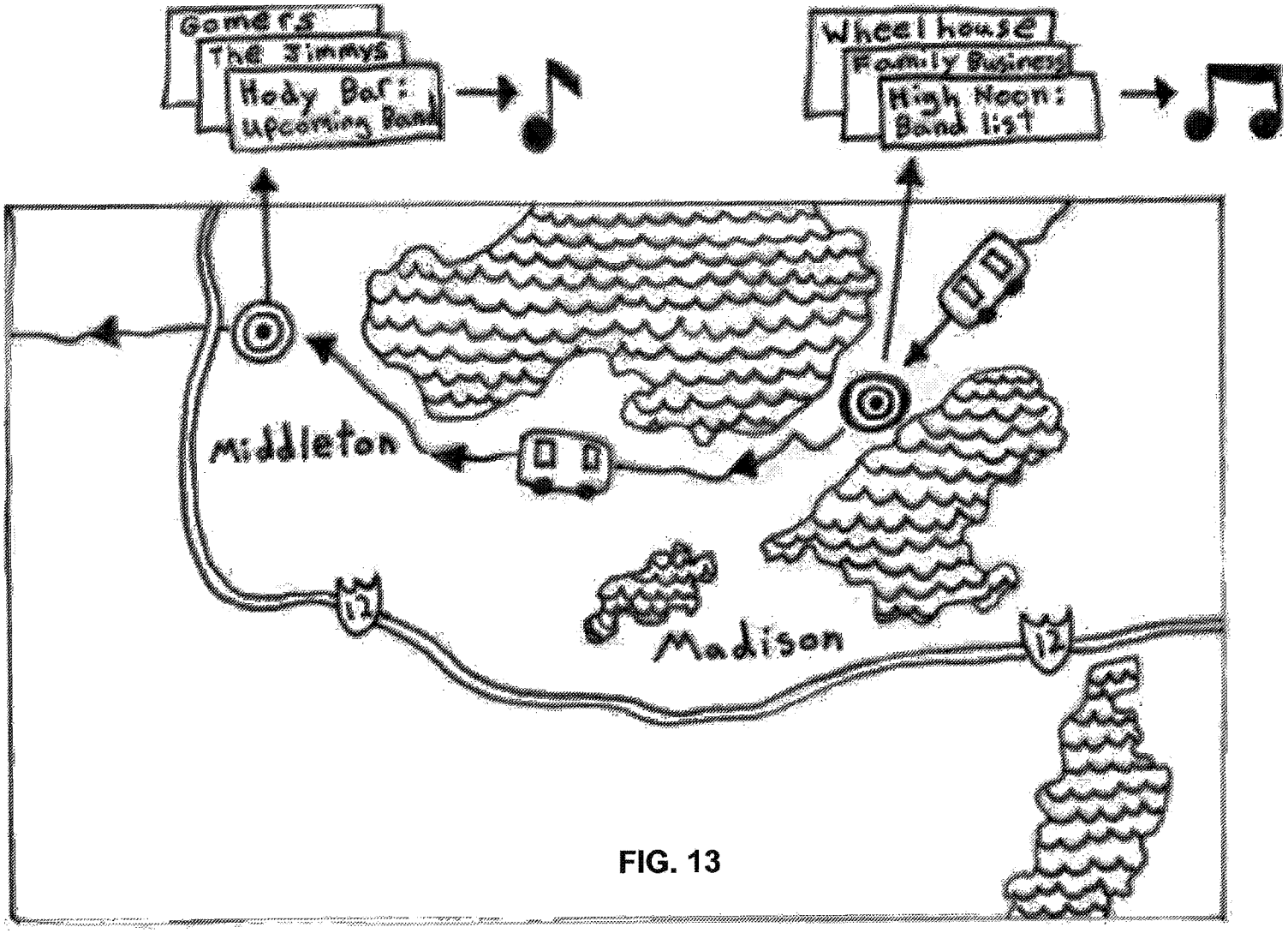
FIG. 13 shows an overview of an embodiment of the present invention wherein a user driving home from work passes a nightclub, a geo sensor of the methods and systems of the present invention triggers production of music from upcoming bands, and display of art from a local gallery is provided on the user's interface.

A person from Madison, Wis. is driving home from work on University Avenue heading west out of town. He is thinking about the upcoming weekend, so he turns on his Iphone, engages the methods and systems of the present invention linked to a geographic sensor that determines his location. (FIG. 13.) He is approaching the Club Tavern on the north side of the street. The methods and systems of the present invention seeks out the club's website, identifies upcoming events, and provides a composition from one of the upcoming bands. As he moves further down the road, he approaches the Hodi Bar in Middleton, Wis. The geographic sensor repeats the process and queues a composition from an upcoming act. The methods and systems of the present invention post images of the band, along with a an image of a painting from the Middleton Art Gallery. When the user arrives home he has a list of who is playing where, what's being exhibited at the art gallery, and many other events in town over the weekend.

Example 9

Figure 14:
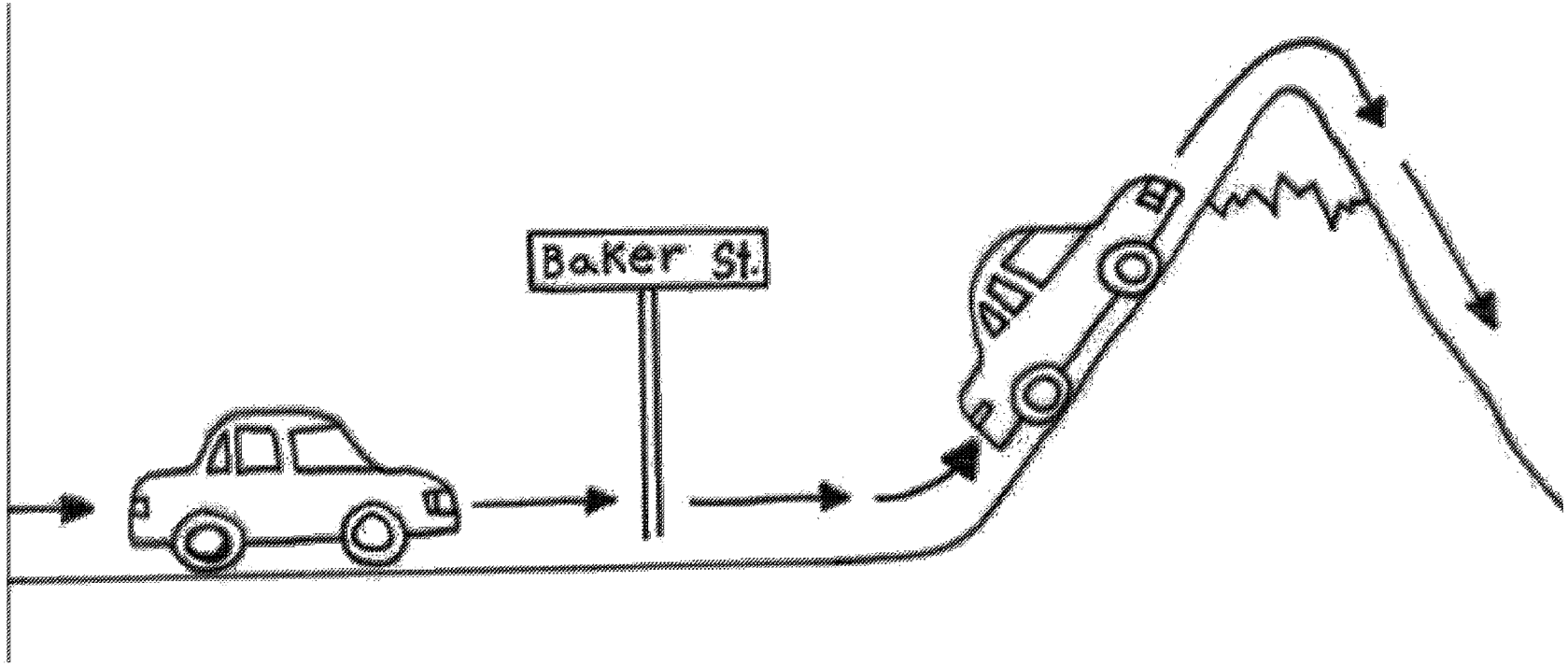
FIG. 14 shows an overview of an embodiment of the present invention wherein a couple driving in the country turns on Baker Street, and climbs a mountain. A geo sensor of the methods and systems of the present invention triggers production of music from a playlist of popular tunes.

A couple is driving in the country, and engages the methods and systems of the present invention for entertainment using their mobile phone or tablet. Using Google maps api or a similar application, they identify their latitude, longitude, name of the street, city, county, state, speed of the car, direction and other attributes that the api provides. The couple makes a right turn on Baker Street, and Gerry Rafferty's song Baker Street is provided. (FIG. 14.) As they climb the hill in front of them, Alabama's Mountain Music is provided. They continue to drive and hear many songs related to their location, direction and geographic terrain. As they move further into the country, they exit onto a highway. Jason and the Scorchers Lost Highway is provided. Over the course of their ride, they hear Highway Song (Blackfoot), a song by Traffic, Where The Blacktop Ends (Keith Urban), Rocky Mountain High (John Denver), Truckin' (Grateful Dead), and many others. On the next trip, they change their genre selection to rap and their song list provides Drive Slow (Kanye West), Just Crusin (Will Smith), Let Me Ride (Dr. Dre) and the like.

Example 10

Figure 15:
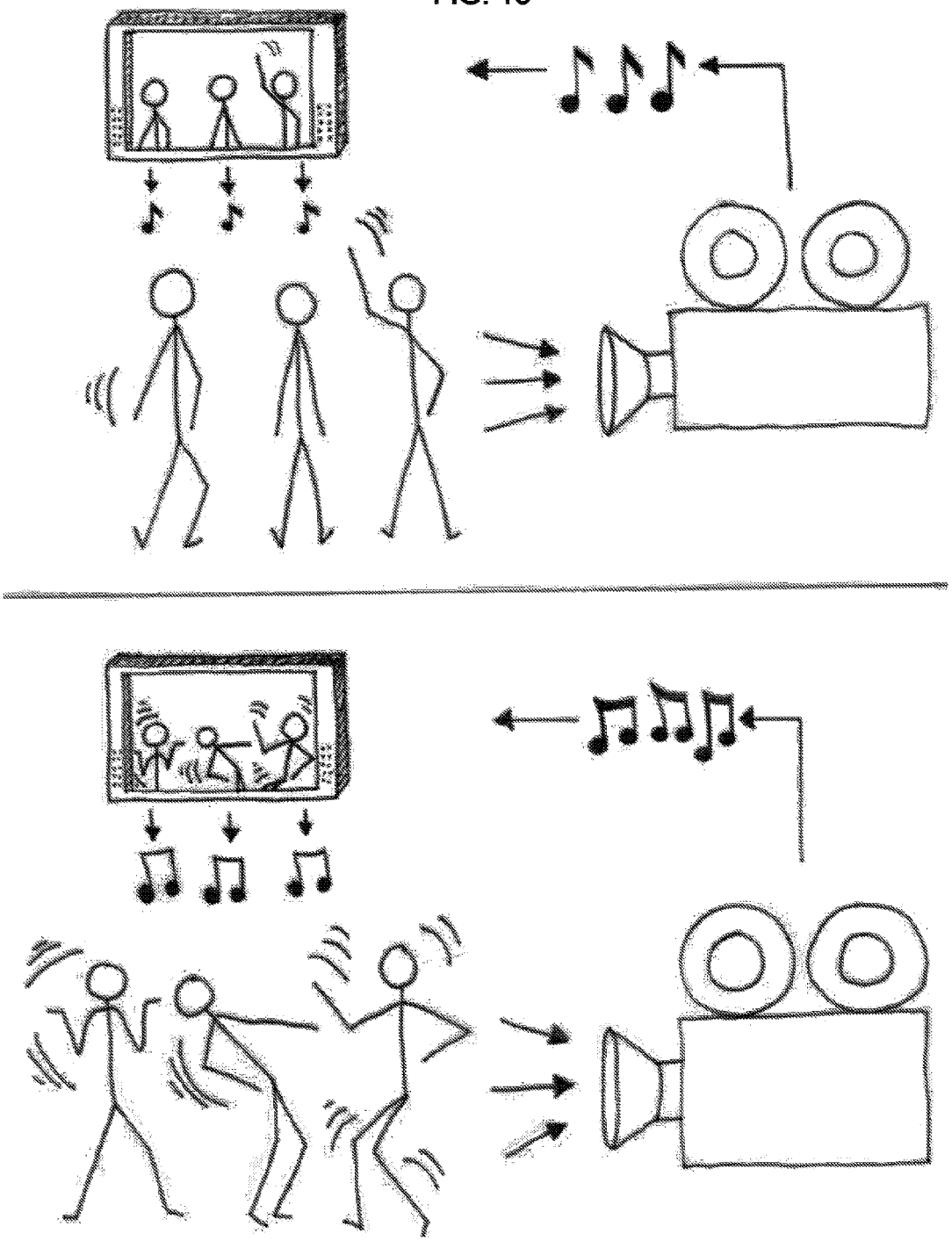
FIG. 15 shows an overview of an embodiment of the present invention wherein friends standing in line at an amusement park observe a monitor on the ceiling, and move their arms to change the speaker's musical audio generation.

A group of friends are standing in line at an amusement park, and a camera mounted to the ceiling is capturing their image and displaying it on a monitor that they can observe. (FIG. 15.) Music is playing continuously directed by the content of the image. When one friend raises a hand to stretch, features of the music change. When the friends realize that their movements are generating changes in the audio output, they move their arms, and jump up and down to learn how their movements are changing the music. As they move forward in the line, the next group of people move up. They music continuously plays based on the pixel values of the images that are captured of the people in line.

Example 11

Figure 16:
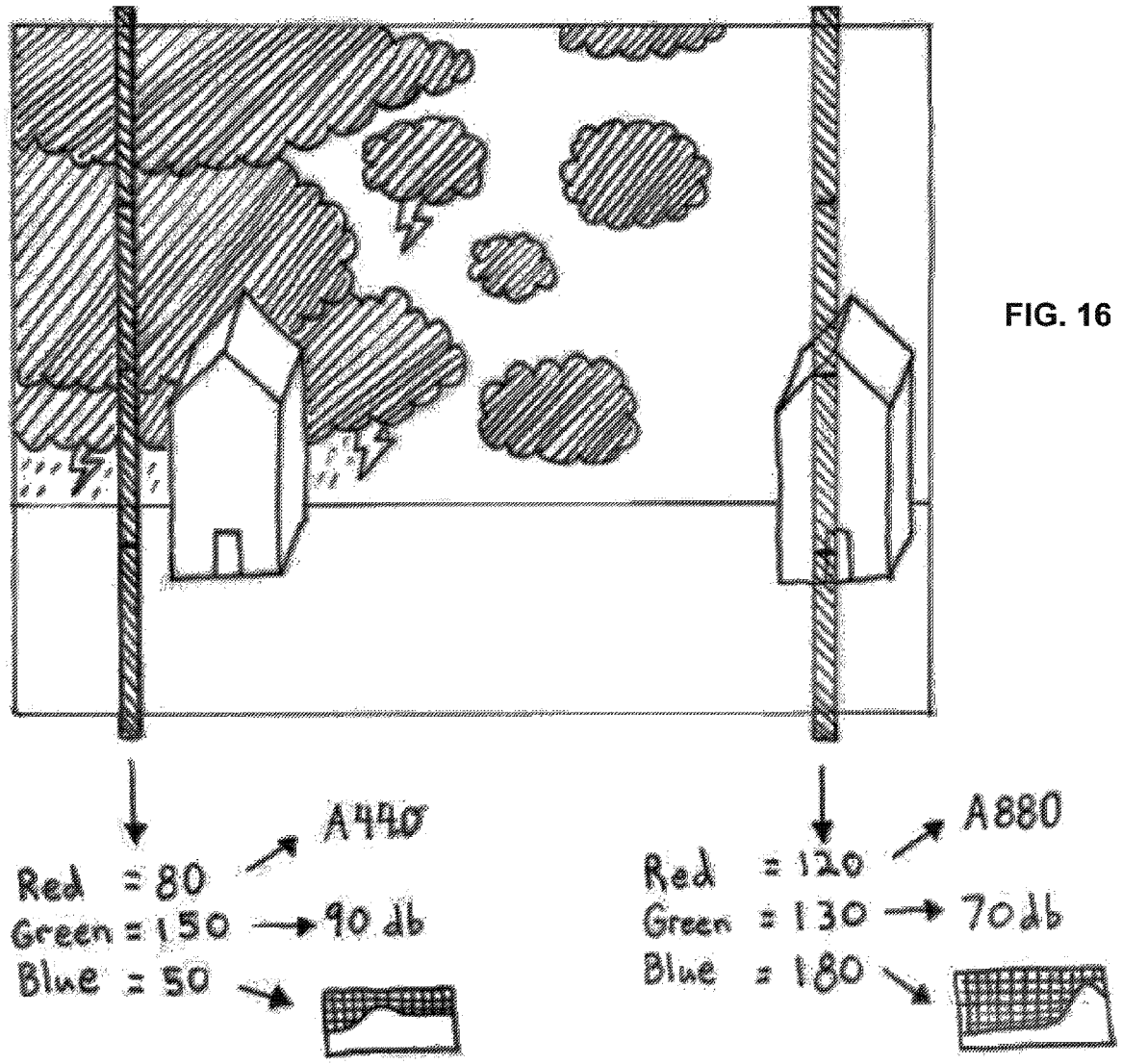
FIG. 16 shows an overview of an embodiment of the present invention wherein a user captures an image, and edits the values of the image to generate distinct audio outputs that differ in pitch, volume and tone of the audio output.

Using a device comprising, for example, a mobile phone, a tablet or a computer, a user acquires an image of the sky with an approaching thunder storm. (FIG. 16.) Half the sky is dark (for example, the left side of the photo), and the other half of the sky is bright with the sun shining through the clouds. The Red Pixel value generates the pitch, the Green Pixel value generates the volume, and the Blue Pixel value generates the tone. In some embodiments, these are the default settings in a software application. In other embodiments, a user selects new values if they have previously been altered. The user selects and makes the changes from an interface on a hardware device of the methods and systems of the present invention. Because the cursor is programmed to move left to right in assigning pixel values, the sounds change, for example, from low values in the pixel range to the brighter high end. This option is selected by the user, and the Red Pixel value (for example, 80) determines the pitch/frequency, that denotes a pitch of 220 Hertz i.e., an A note an octave below A 440. The Green Pixel volume value (150) is 80 db. The Blue Pixel value (50) provides the equivalent of pushing sliders of the low end graphic equalizer up, and the high end down proportionately. Accordingly, the overall sound is a low note, at medium volume, and sounds are muffled as the frequencies are mostly on the low end spectrum. As the cursor moves left to right across the image, the pixel values change gradually to R=120, G=130 and B=180. Thus, the sound moves higher in pitch, lower in volume, and becomes much brighter as the sky opens and turns blue.

Example 12

Figure 17:
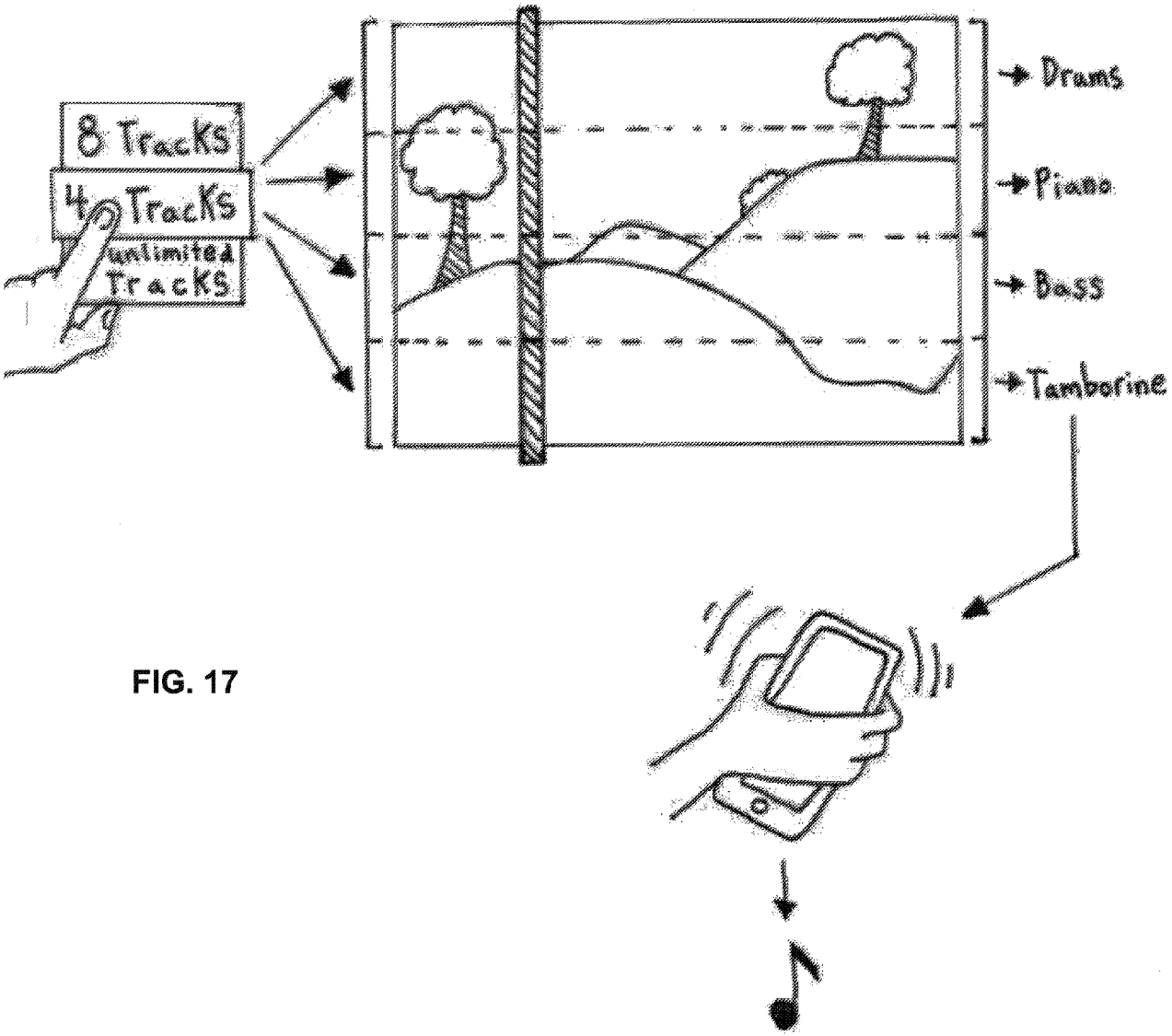
FIG. 17 shows an overview of an embodiment of the present invention wherein a user creates an audio output from a photograph from her image gallery. The user assigns one track to a tambourine audio output linked to a physical modulator of the methods and systems of the present invention. She shakes her phone in time with the music to direct the tempo of the tambourine from an audio library.

A user captures an image from a device, stores it in their gallery, and applies an audio application of the present invention to the image. Multiple tracks are used including a drum, bass, guitar, keyboards and a tambourine (Track 5). Using controls providing in the application, the user selects track 5, and applies a "shaking" modulator to the tambourine sound. (FIG. 17.) As used herein, modulators are hardware and software devices that may be programmed to alter the audio output. RGB values are pre-programmed, or user-programmable, to alter pitch, volume, tone, modulators, sound selection, add an effect, or to establish the length of the audio output. The user shakes their video image acquisition device in time with the audio output as if they were shaking a tambourine. In a related example, a performer modulates a tambourine audio parameter as above, a first listener taps a device of the system of the present invention, and a second user blows into a microphone linked to the system to modulate a trumpet track.

Example 13

Figure 18:
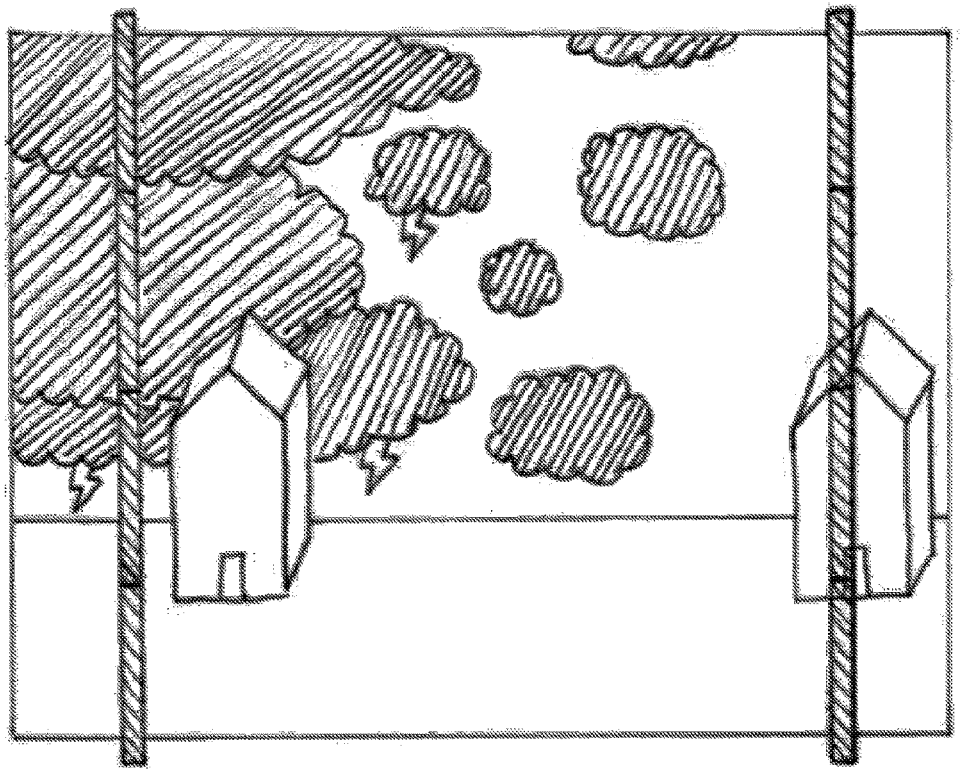
FIG. 18 shows an overview of an embodiment of the present invention wherein a hiker edits one of many images of a thunderstorm captured on a hike. The user selects the addition of a low frequency oscillator as modulator of the image, and controls the output of the audio composition to reflect the swirling feel of the storm. The user elects to begin the audio output using a cursor at the left side of the image. As the cursor moves to the right, augu the volume decreases.
Figure 18:
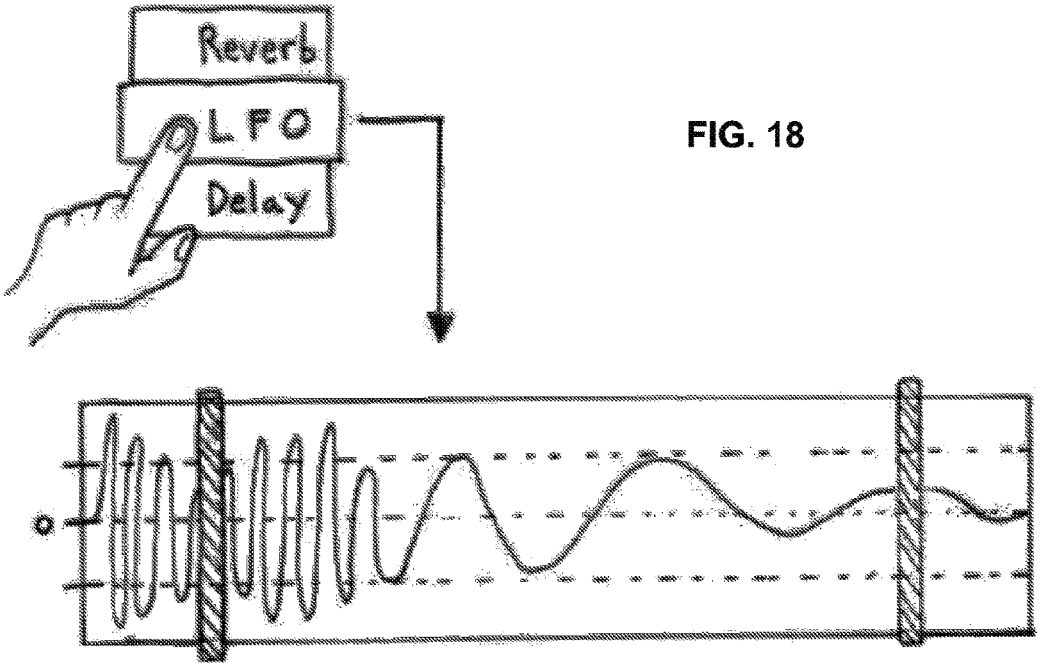

A lone hiker is walking through the country, and comes upon a serene farm scene, and captures the view on his digital camera. He takes hundreds of shots, and continues as he sees a thunderstorm approaching in the distance. (FIG. 18.) He captures the thunderstorm as multiple visual images and returns home. The hiker creates an album that documents the images along the trail while at the same time a background audio track is supporting and slightly changing with the images. One image is a photo taken of the thunderstorm wherein half of the sky is dark (for example, the left side of the photo), and the other half is still bright with the sun shining through the clouds. When he presses the play command, the cursor is programmed to move left to right assigning pixel values, then the sounds change from the low end of the pixel range to the brighter high end as the pixel values increase. He selects the left side of the image to have different effect on the tones, such as a rotating speaker, swirling effects, or a sound similar to what might be generated from the opposite side of a slow moving fan. This will helps him share what he experiences in the thunderstorm by enabling the viewer to hear it as well. The hiker selects the low frequency oscillator function, and applies this modulator to the volume. As the cursor moves left to right, the speed of the fan decreases as the pixel differential decreases to more accurately reflect the unpredictable sounds of a thunderstorm. Eventually, the modulator shuts off when the blue open sky is reached. The hiker, now a blogger, uploads his photo and audio work to his blog, and shares his experience with his followers.

Various modifications and variations of the described method and system of the invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention that are obvious to those skilled in the relevant fields are intended to be within the scope of the present invention.

I claim:

1. A method for audio composition generation using at least one computer system, said computer system comprising a processor, a user interface, a visual image display screen, a sound database, an audio composition computer program on a computer readable medium configured to receive input from said visual image display screen and from said sound database to generate an audio composition, and an audio system, said method comprising:

a) displaying a visual image on said visual image display screen;

b) receiving a user's input relating to one or more audio parameters;

c) scanning said visual image to identify a plurality of visual image regions;

d) selecting and assembling a plurality of blocks in said sound database based on said visual image regions and said user's input of said one or more audio parameters; and e) generating said audio composition based on said selecting and assembling said plurality of blocks in said sound database using said audio system, wherein each of said plurality of blocks in said sound database is assigned a tag, and wherein said selecting and assembling a plurality of blocks from said sound database based on said visual image regions and said user's input of said one or more audio parameters comprises at least one user-determined filter to pass and to not pass said tags of said blocks to said auditory composition.

2. The method of claim 1, wherein said generating said audio composition based on said selecting and assembling said plurality of blocks in said sound database using said audio system is in real time.

3. The method of claim 1, wherein said visual image on said visual image display screen comprises a digital photograph, a digital photograph selected from a digital photograph database, a digital photograph selected from a web-based database, a captured digital image, a digital video image, a film image, a visual hologram or a user-edited visual image.

4. The method of claim 1, wherein said plurality of blocks in said sound database comprise a note comprising a duration, pitch, volume or tonal content, or a plurality of notes comprising melody, harmony, rhythm, tempo, voice, key signature, key change, intonation, temper, repetition, tracks, samples, loops, counterpoint, dissonance, sound effects, reverberation, delay, chorus, flange, dynamics, instrumentation, artist or artists sources, musical genre or style, monophonic and stereophonic reproduction, equalization, compression and mute/unmute blocks.

5. The method of claim 1, wherein said plurality of blocks in said sound database comprise a recorded analog or digital sound, an analog or digital sound selected from a recording database, a digital sound selected from a web-based database, or a user-edited analog or digital sound.

6. The method of claim 1, further comprising receiving a user's input relating to compatibility, alignment and transposition of said plurality of said passed blocks from said sound database to said audio composition.

7. The method of claim 1, wherein said user interface is a screen interface, a keyboard interface, or a voice recognition interface.

8. The method of claim 1, wherein said visual image display screen comprises at least one cursor configured to scan said visual image for input relating to said plurality of visual image regions of said displayed visual image.

9. The method of claim 8, further comprising receiving said user's input relating to said plurality of said visual image regions.

10. The method of claim 9, wherein said receiving said user's input relating to said plurality of said visual image regions of said displayed visual image comprises said user's input relating to the number, orientation, dimensions, rate of travel, direction of travel, steerability and image resolution of said at least one cursor.

11. The method of claim 9, wherein said user's input relating to said plurality of said visual image regions of said displayed visual image comprises input relating to one or more pixel dimensions, coordinates, brightness, grey scale, or RGB scale, visual image regions comprising a plurality of pixels with user input relating to dimensions, color, tone, composition, content, feature resolution, a combination thereof, or a user-edited visual image region.

12. The method of claim 1, further comprising receiving a user's input relating to said audio composition computer program on said computer readable medium.

13. The method of claim 1, further comprising receiving a user's input relating to generating said audio composition using said audio system.

14. The method of claim 1, wherein said audio composition is stored on a computer readable medium, stored in said sound database, stored on a web-based medium, edited, privately shared, publicly shared, available for sale, licensed, or converted to a visual image.

15. The method of claim 1, wherein said audio composition computer program on a computer readable medium configured to receive input from said visual image display screen and from said sound database to generate an audio composition is downloadable to a mobile device, a phone, a tablet, a computer, a device configured to receive Mp3 files, or other digital source.

16. The method of claim 1, further comprising receiving auditory input in real time.

17. The method of claim 1, further comprising receiving GPS coordinates to filter said blocks of said sound database specific to a location, or to the distance and rate of travel between a plurality of locations.

18. The method of claim 1, wherein said visual image on said visual image display screen is a visual image text.

19. A system comprising a computer configured to practice the method of claim 1.

20. The system of claim 19, further comprising software that directs said computer to practice the method of claim 1.

* * * * *